US008100815B2

(12) United States Patent
Balaker et al.

(10) Patent No.: US 8,100,815 B2
(45) **Date of Patent: *Jan. 24, 2012**

(54) EXERCISE DEVICE

(76) Inventors: Matt Balaker, West Hollywood, CA (US); Christopher Thompson, Palo Alto, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/968,181

(22) Filed: Dec. 14, 2010

(65) Prior Publication Data

US 2011/0098161 A1 Apr. 28, 2011

Related U.S. Application Data

(63) Continuation of application No. 11/546,666, filed on Oct. 12, 2006, now Pat. No. 7,850,578.

(51) Int. Cl.
*A63B 22/00* (2006.01)
*A63B 21/00* (2006.01)

(52) U.S. Cl. ..... 482/70; 482/131

(58) Field of Classification Search ..... 482/51, 482/70–71, 74, 91, 101, 121, 123, 129, 130, 482/145, 907

See application file for complete search history.

(56) References Cited

U.S. PATENT DOCUMENTS

| | | | | |
|---|---|---|---|---|
| 1,144,085 | A | | 6/1915 | Abplanalp |
| 2,812,010 | A | | 11/1957 | Abdallah |
| 2,819,755 | A | | 1/1958 | Harold et al. |
| 3,117,782 | A | | 1/1964 | Johnston |
| 3,752,474 | A | | 8/1973 | Macabet et al. |
| 3,791,645 | A | | 2/1974 | Stelma |
| 3,979,114 | A | | 9/1976 | Codina |
| 4,205,839 | A | | 6/1980 | Best |
| 4,340,214 | A | | 7/1982 | Schutzer |
| 4,506,884 | A | | 3/1985 | Hankin |
| 4,781,372 | A | | 11/1988 | McCormack |
| 4,826,158 | A | | 5/1989 | Fields, Jr. |
| 4,907,798 | A | | 3/1990 | Burchatz |
| 4,948,121 | A | | 8/1990 | Haaheim et al. |
| 4,993,407 | A | | 2/1991 | Chen |
| 5,031,898 | A | | 7/1991 | Anthony |
| 5,147,266 | A | * | 9/1992 | Ricard ..... 482/131 |
| 5,209,711 | A | | 5/1993 | Scrima |
| 5,242,347 | A | * | 9/1993 | Keeton ..... 482/102 |
| 5,279,532 | A | | 1/1994 | Chen |
| 5,295,935 | A | | 3/1994 | Wang |
| 5,328,427 | A | | 7/1994 | Sleamaker |
| 5,405,306 | A | * | 4/1995 | Goldsmith et al. ..... 482/120 |
| 5,407,411 | A | | 4/1995 | Trainor |
| 5,503,609 | A | | 4/1996 | Bull |
| 5,520,598 | A | | 5/1996 | Little |
| 5,667,461 | A | * | 9/1997 | Hall ..... 482/69 |
| 5,690,590 | A | | 11/1997 | Lo |
| 5,725,462 | A | | 3/1998 | Jones |
| 5,749,811 | A | | 5/1998 | Wilson |

(Continued)

FOREIGN PATENT DOCUMENTS

WO WO 96/38206 12/1996

*Primary Examiner* — Loan Thanh
*Assistant Examiner* — Sandhara Ganesan
(74) *Attorney, Agent, or Firm* — Cislo & Thomas, LLP

(57) ABSTRACT

An exercise device comprising a frame; and a plurality of platforms for accommodating an exerciser's feet, each platform of the plurality of platforms including at least one moving member for facilitating both a divergent movement and a convergent movement. The device includes a tensioning structure for providing adjustable resistance.

20 Claims, 18 Drawing Sheets

U.S. PATENT DOCUMENTS

| | | | | |
|---|---|---|---|---|
| 5,911,650 | A | 6/1999 | Cox | |
| 5,951,449 | A * | 9/1999 | Oppriecht | 482/113 |
| 5,989,163 | A | 11/1999 | Rodgers, Jr. | |
| 6,106,444 | A | 8/2000 | Maingart | |
| 6,368,254 | B1 | 4/2002 | Wall | |
| 6,514,180 | B1 | 2/2003 | Rawls | |
| 6,527,683 | B2 * | 3/2003 | Tolles | 482/99 |
| 6,612,845 | B1 | 9/2003 | Macri et al. | |
| 6,786,850 | B2 | 9/2004 | Nizamuddin | |
| 7,101,327 | B1 * | 9/2006 | Baumler et al. | 482/136 |
| 7,115,073 | B2 | 10/2006 | Nizamuddin | |
| 7,125,367 | B1 | 10/2006 | Stearns | |
| 7,134,987 | B2 | 11/2006 | Goldstein | |
| 7,294,100 | B2 | 11/2007 | Bull | |
| 7,438,673 | B1 | 10/2008 | Jones | |
| 2004/0014569 | A1 | 1/2004 | Loane | |

* cited by examiner

FIG. 13
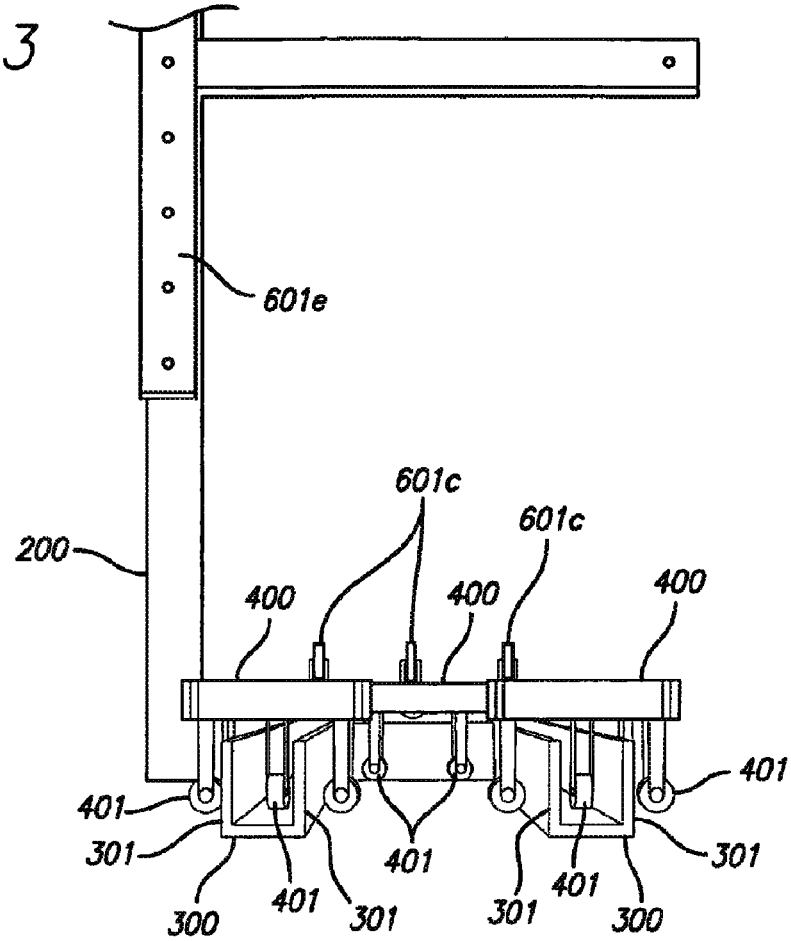
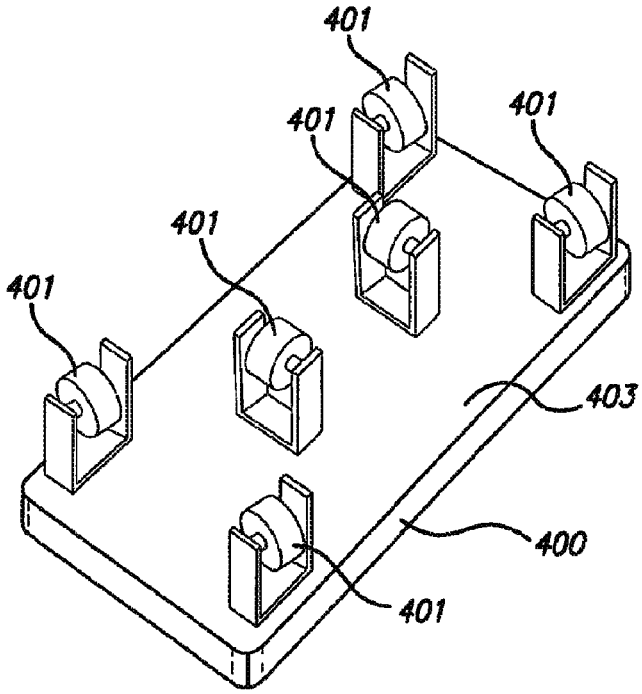
FIG. 14

EXERCISE DEVICE

CROSS-REFERENCE

This patent application is a continuation application of U.S. patent application No. 11/546,666, filed Oct. 12, 2006 (now U.S. Pat. No. 7,850,578), which application is incorporated in its entirety here by this reference.

TECHNICAL FIELD

The present invention technically relates to systems, apparatuses, devices, and methods for exercising. More particularly, the present invention technically relates to systems, apparatuses, devices, and methods for exercising multiple muscle groups. Even more particularly, the present invention technically relates to systems, apparatuses, devices, and methods for exercising multiple muscle groups simultaneously.

BACKGROUND ART

Various related art systems, apparatuses, and methods for facilitating arm and leg exercises exist. One such apparatus comprises an arm/leg push/pull exercise device where the arms and legs of the user are connected by cables and pulleys and the user engages the device in an upright manner. The device also includes rolling foot supports that connect to an anchor. Some other current related art inventions include: a leg exercise device having foot supports that move along repositionable tracks, wherein the foot supports are connected to a resistance system, and wherein the tracks have a structure for preventing the movement of the foot supports; an exercise apparatus wherein a user's arms and legs are connected by a system of straps and pulleys, and wherein the user engages the exercise device while standing; a push/pull exercise device, wherein a user's arms and legs are connected by a system of lines and pulleys, and wherein the user engages the exercise device while standing; and an exercise apparatus for simulating skating having rotatable foot pedals for altering the type of motion and a resistance device that resists the movement of the pedals.

Yet other related art inventions include: an apparatus for training a user to perform proper body movements, wherein the device is a frame having bands connected to a harness on a user's body that restrains the user's movement into appropriate directions; an exercise device for people who have suffered from attacks or paralysis, wherein the device is a frame, and wherein a set of rotating pedals are connected to a pair of cables by a pulley system for moving the user's arms up and down; a push/pull exercise device, wherein the user's arms and legs are connected by ropes and pulleys, and wherein the user performs the exercises while in a prone position; and a system of ropes, pulleys, and counterweights that aid a user in performing exercises of varying difficulties.

However, these related art systems, apparatuses, and methods do not provide any adjustable resistance for exercising multiple muscle groups simultaneously. These related art exercise systems typically employ spools, which tend to lose energy through its reels, the energy being supplied by forces exerted by the exerciser's limbs, thereby rendering the system inefficient, especially for isometric exercise. Thus, a need is seen to exist for a device and corresponding methods which provide adjustable resistance or conserved energy resistance for exercising multiple muscle groups simultaneously.

DISCLOSURE OF THE INVENTION

The present invention addresses the needs in the related art in a device and corresponding methods which provide adjustable resistance or conserved energy resistance for exercising multiple muscle groups simultaneously. The present invention promotes strength, toning, and flexibility of major muscle groups in the inner and the outer leg through a combination of elements which facilitates divergent as well as convergent motions. In contrast to the related art systems, apparatuses, and methods, the present invention pulley system transfers energy directly from one limb to another from forces exerted by the exerciser's limb, wherein energy loss is minimized in the device, thereby rendering the device efficient, especially for an isometric exercise. As such, not only are the limbs exercised simultaneously in the present exercise device, they are also exercised dependently.

The present invention exercise device generally comprises: a frame; a track being mechanically coupled to the frame; and a plurality of platforms for accommodating an exerciser's feet, each platform of the plurality of platforms comprising at least one moving member, such as at least one wheel, for facilitating both a divergent movement and a convergent movement, the at least one moving member moving on the track.

The present invention method of fabricating an exercise device generally comprises the steps of: providing a frame; providing a track being mechanically coupled to the frame; and providing a plurality of platforms for accommodating an exerciser's feet, each platform of the plurality of platforms comprising at least one moving member, such as at least one wheel, for facilitating both a divergent movement and a convergent movement, the at least one moving member moving on the track.

The present invention method of exercising by way of an exercise device generally comprises the steps of: providing an exercise device, providing a frame; providing a track being mechanically coupled to the frame; providing a plurality of platforms for accommodating an exerciser's feet, each platform of the plurality of platforms comprising at least one moving member, such as at least one wheel, for facilitating both a divergent movement and a convergent movement, the at least one moving member moving on the track; providing a structure for tensioning being mechanically coupled to the plurality of platforms for facilitating both the divergent and the convergent movement and for facilitating an upper body strengthening exercise; providing a pulley system, the pulley system providing step comprising providing the pulley system being mechanically coupled to the frame, wherein the tensioning structure providing step comprises providing the tensioning structure being also mechanically coupled to the pulley system; placing the exerciser's feet on the plurality of platforms; and moving the plurality of platforms outwardly and inwardly, thereby performing both the divergent movement and the convergent movement.

Advantages of the present invention include, but are not limited to, improving balance, i.e., gait stabilization, improving coordination of the arms and the legs, and strengthening of core abdominal muscle groups as well as muscle groups of the upper back, the shoulders, the arms, and the hands. Other advantages and features of the present invention are disclosed or are apparent, in the section entitled "Mode(s) for Carrying-Out the Invention," disclosed, infra.

BRIEF DESCRIPTION OF THE DRAWING

For better understanding of the present invention, reference is made to the below-referenced accompanying Drawing. Reference numbers refer to the same or equivalent parts of the present invention throughout the several figures of the Drawing.

FIG. 13 is a cut-away perspective view of an exercise device, showing the orientation of a plurality of platforms in relation to a track, by example only, in accordance with the present invention.

FIG. 14 is a perspective view of a lower surface of a platform, showing the orientation of a plurality of wheels for facilitating either a perpendicular orientation to the track or a parallel orientation to the track, by example only, in accordance with the present invention.

MODE(S) FOR CARRYING-OUT THE INVENTION

Figure 1:
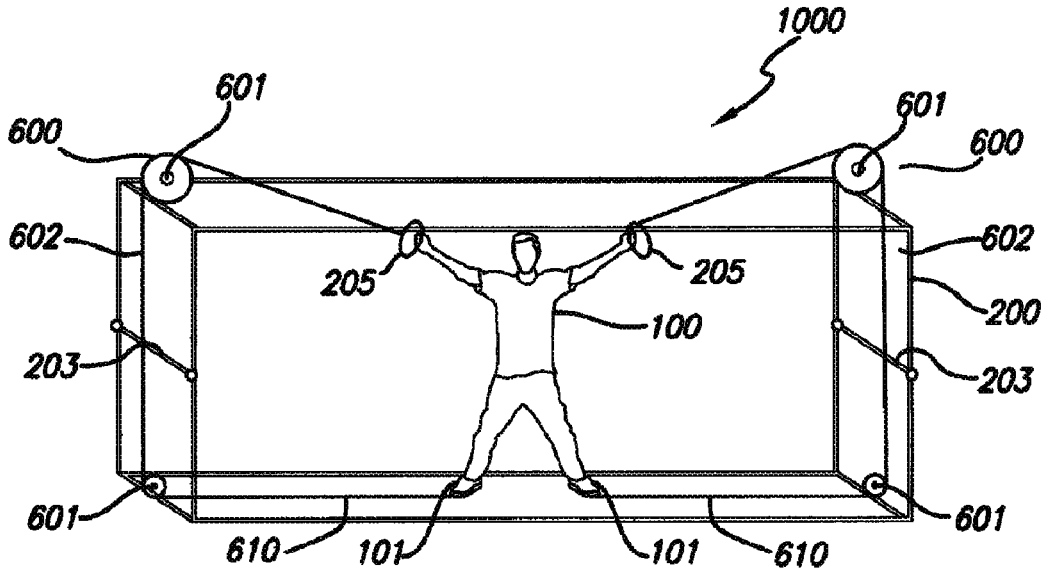
FIG. 1 is a schematic diagram of an exercise device shown in relation to an exerciser, in accordance with the present invention.

FIG. 1 illustrates, in a schematic diagram, an exercise device 1000 shown in relation to an exerciser 100, in accordance with the present invention. The exercise device 1000 comprises a frame 200; a track 300 being mechanically coupled to the frame 200; a plurality of platforms 400 for accommodating an exerciser's feet 101, each platform of the plurality of platforms 400 comprising at least one wheel 401 for facilitating both a divergent movement and a convergent movement, the at least one wheel 401 rolling on the track 300; a structure for tensioning 500 being mechanically coupled to the plurality of platforms 400 for facilitating both the divergent movement and the convergent movement and for facilitating an upper body strengthening exercise; and a pulley system 600, the pulley system 600 being mechanically coupled to the frame 200, wherein the tensioning structure 500 is also mechanically coupled to the pulley system 600, wherein the divergent and the convergent movements together comprise at least one movement selected from a group consisting essentially of a horizontal split and a lunge split, wherein the track 300 comprises a structure for stopping 700 at least one platform of the plurality of platforms 400, wherein the stopping structure 700 comprises at least one hole 701 for accommodating a pin 702 for limiting a range of motion in a selected direction, wherein the at least one hole 701 comprises a plurality of intermittent holes for facilitating selection of a direction by the exerciser 100, whereby an exercise is facilitated, wherein the at least one exercise comprises at least one technique selected from a group consisting essentially of a cardiovascular technique and an isometric technique, and wherein the tensioning structure comprises at least one mechanism selected from a group consisting essentially of a spring, a piston, and a hydraulic pump. The at least one wheel 401 may be mounted at a location such as on the lower surfaces of the plurality of platforms 400 and on the sides of the plurality of platforms 400.

Figure 2:
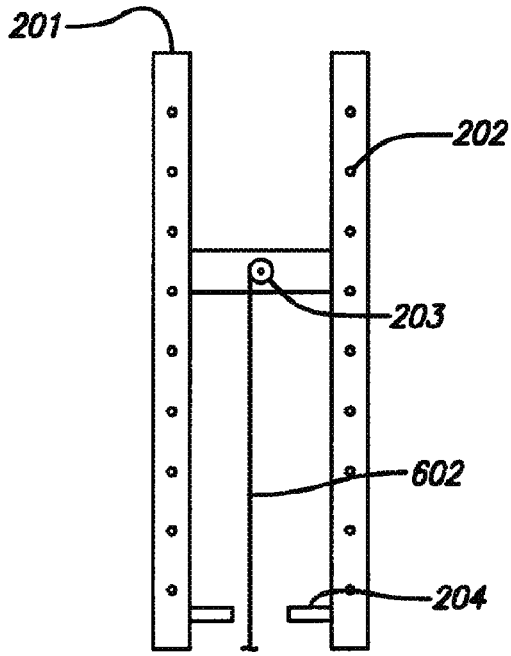
FIG. 2 is a schematic diagram of a framing member in an exercise device, in accordance with the present invention.

Referring to FIG. 1 and then to FIG. 2, the frame 200 comprises a generally rectanguloid configuration and is fabricated from a rigid material, in accordance with the present invention. The frame 200 comprises framing members 201 having perforations 202 and may further comprise a cross-bar or a width support bar 203 being mechanically coupled to a pulley 601 having a cable 602, and a fixed hand grip 204. The frame 200 comprises a width in a range of approximately 3 feet, a length in a range of approximately 8 feet, and a height in a range of approximately 8 feet. The track 300 is disposed along the length of the frame 200 and proximate to the ground or floor. The slack of the pulley system 600 may be extended from the width support bar 203, whereby the exerciser 100 may place straps around his feet and/or ankles. The universal foot pedals are conducive for use of the device 1000 by the exerciser 100 in a semi-prone position, whereby the exerciser 100 supports his or her weight with the arms placed on the front pedals, and whereby the exerciser 100 performs converging and diverging arm movements via the track 300, whereby resistance is felt in either or both movement directions. A lateral support bar, such as the cross-bar or the width support bar 203, is disposed parallel to the plurality of platforms 400 and is vertically adjustable. At least one pulley 601 of the pulley system 600 is mechanically coupled to the lateral support bar and move in relation thereto. The cable length of the pulley 601 is variable for providing a range of motion as required by a given exercise. The cable 602 is attached to a handle 205 at a first end and the universal foot pedal or platform 400 at a second end.

Figure 3:
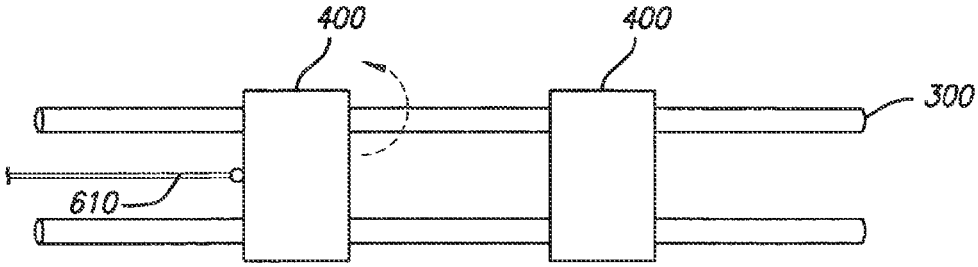
FIG. 3 is a schematic diagram of a track and a plurality of platforms comprising monocoque structures of the exercise device of FIG. 1, in accordance with the present invention.

FIG. 3 illustrates, in a schematic diagram, a track and a plurality of platforms 400, Each platform of the plurality of platforms 400 has a lower surface. Alternatively, the at least one moving member comprises at least one monocoque structure 402, instead of the at least one wheel 401, disposed at a location such as on a lower surface of each platform of the plurality of platforms and on a side of each platform of the plurality of platforms 400, for facilitating sliding of the plurality of platforms 400 on the track 300. The monocoque structure 402 is rotatably mounted to each platform 400 and may be full monocoque or semi-monocoque. The monocoque structure 402 may comprise a sleeve configuration. The pulley system 600 comprises a cable linkage 610 being fastened to the plurality of platforms 400. The plurality of platforms 400 can articulate and comprises a plurality of universal pedals, the universal pedals being rotatable for facilitating switching from a horizontal split exercise to a lunge split exercise, i.e., accommodating the relative orientations of the exerciser's feet. The track 300 comprises a tubular structure.

Figure 4:
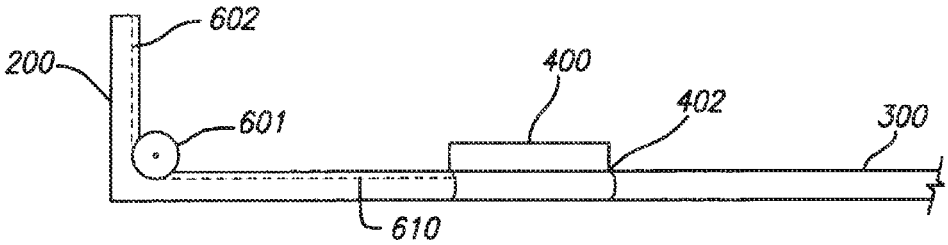
FIG. 4 is a schematic diagram of a monocoque structure shown in relation to the track of FIG. 2, in accordance with the present invention.

FIG. 4 illustrates, in a schematic diagram, a monocoque structure 402 shown in relation to the track 300, of FIG. 2, and to the frame 200, in accordance with the present invention. The monocoque structure 402 slides or glides along the track 300. The device 1000 may further comprise a material for lubricating the track 300 or for reducing friction between the track 300 and the monocoque structure 402, such as grease, oil, carbon-containing lubricants, and fluorinated polymers (not shown). As each pedal rolls, slides, or glides on the track 300, both sides of the abdominal muscles receive equal benefit. In particular, this feature is advantageous for physical therapy and rehabilitation as well as for general exercise and fitness.

Figure 5:
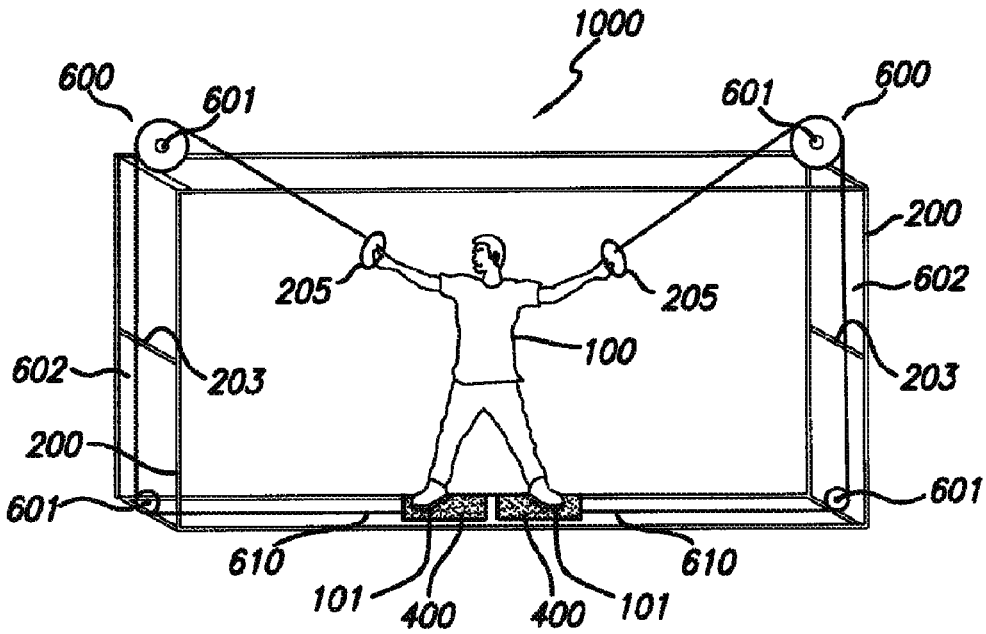
FIG. 5 is a schematic diagram of an exercise device shown in relation an exerciser performing a horizontal split, by example only, in accordance with the present invention.
Figure 6:
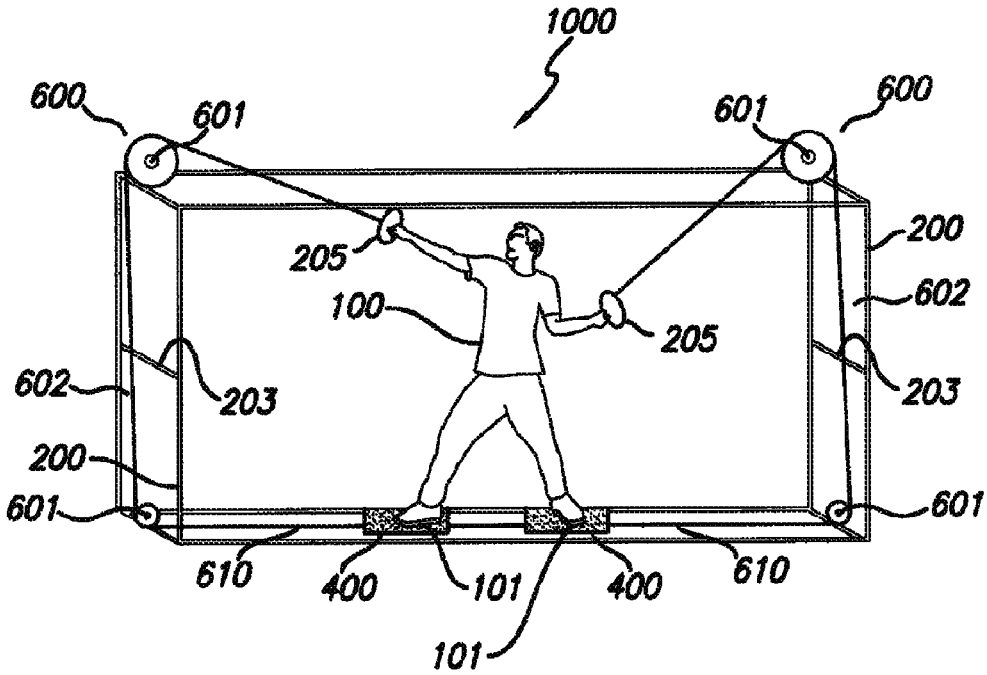
FIG. 6 is a schematic diagram of an exercise device shown in relation to an exerciser performing a lunge split, by example only, in accordance with the present invention.
Figure 7:
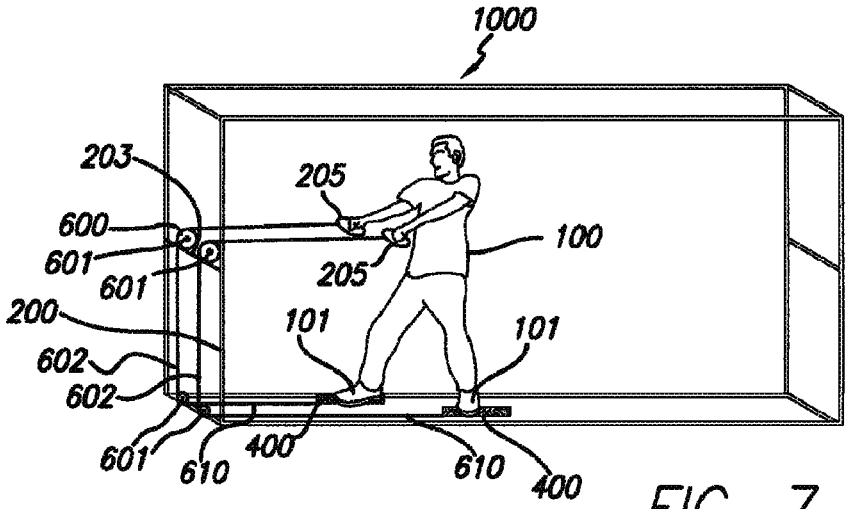
FIG. 7 is a schematic diagram of an exercise device shown in relation to an exerciser performing a cross-country ski movement, by example only, in accordance with the present invention.
Figure 8:
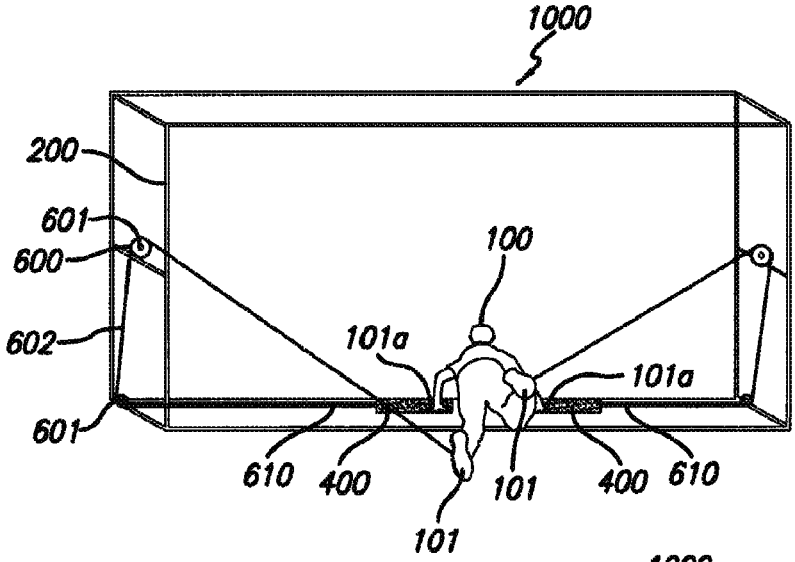
FIG. 8 is a schematic diagram of an exercise device shown in relation to an exerciser performing a chest press with a leg lift, by example only, in accordance with the present invention.
Figure 9:
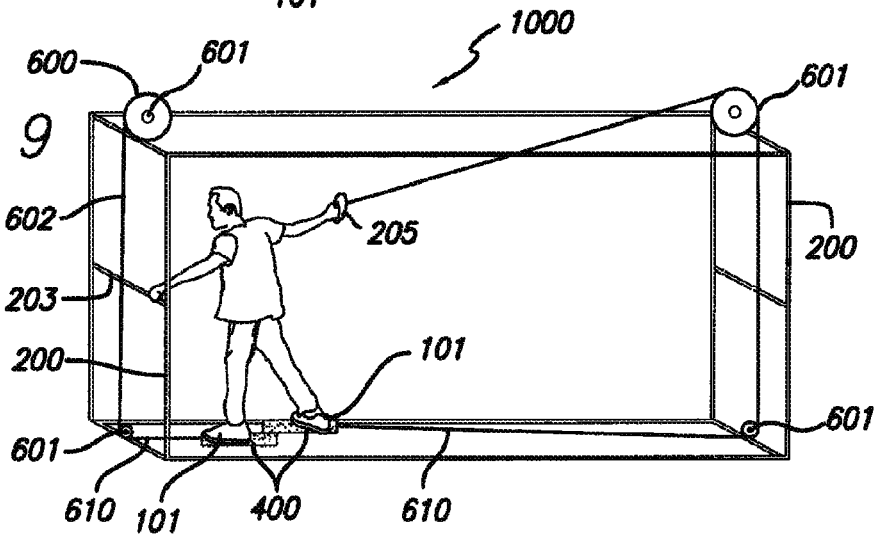
FIG. 9 is a schematic diagram of an exercise device shown in relation to an exerciser performing a forward lunge with a right arm and right leg coordinated stretch, by example only, in accordance with the present invention.

Referring to FIGS. 5-9, several exemplary exercises are demonstrated using the device 1000, in accordance with the present invention. FIG. 5 illustrates, in a schematic diagram, an exercise device 1000 shown in relation to an exerciser 100 performing a horizontal split. FIG. 6 illustrates, in a schematic diagram, an exercise device 1000 shown in relation to an exerciser 100 performing a lunge split. FIG. 7 illustrates, in a schematic diagram, an exercise device 1000 shown in relation to an exerciser 100 performing a cross-country ski movement. FIG. 8 illustrates, in a schematic diagram, an exercise device 1000 shown in relation to an exerciser 100 performing a chest press with a leg lift. FIG. 9 illustrates, in a schematic diagram, an exercise device 1000 shown in relation to an exerciser 100 performing a forward lunge with a right arm and right leg coordinated stretch. The pulley system 600 is adjustably coupled to the frame 200 so as to accommodate these and other different exercises on the same exercise device 1000. In the preferred embodiment, the pulleys 601 are adjustably coupled to the cross-bars so that any pulley 601 can mounted on any cross-bar as shown in the examples in FIGS. 7-9.

Figure 10:
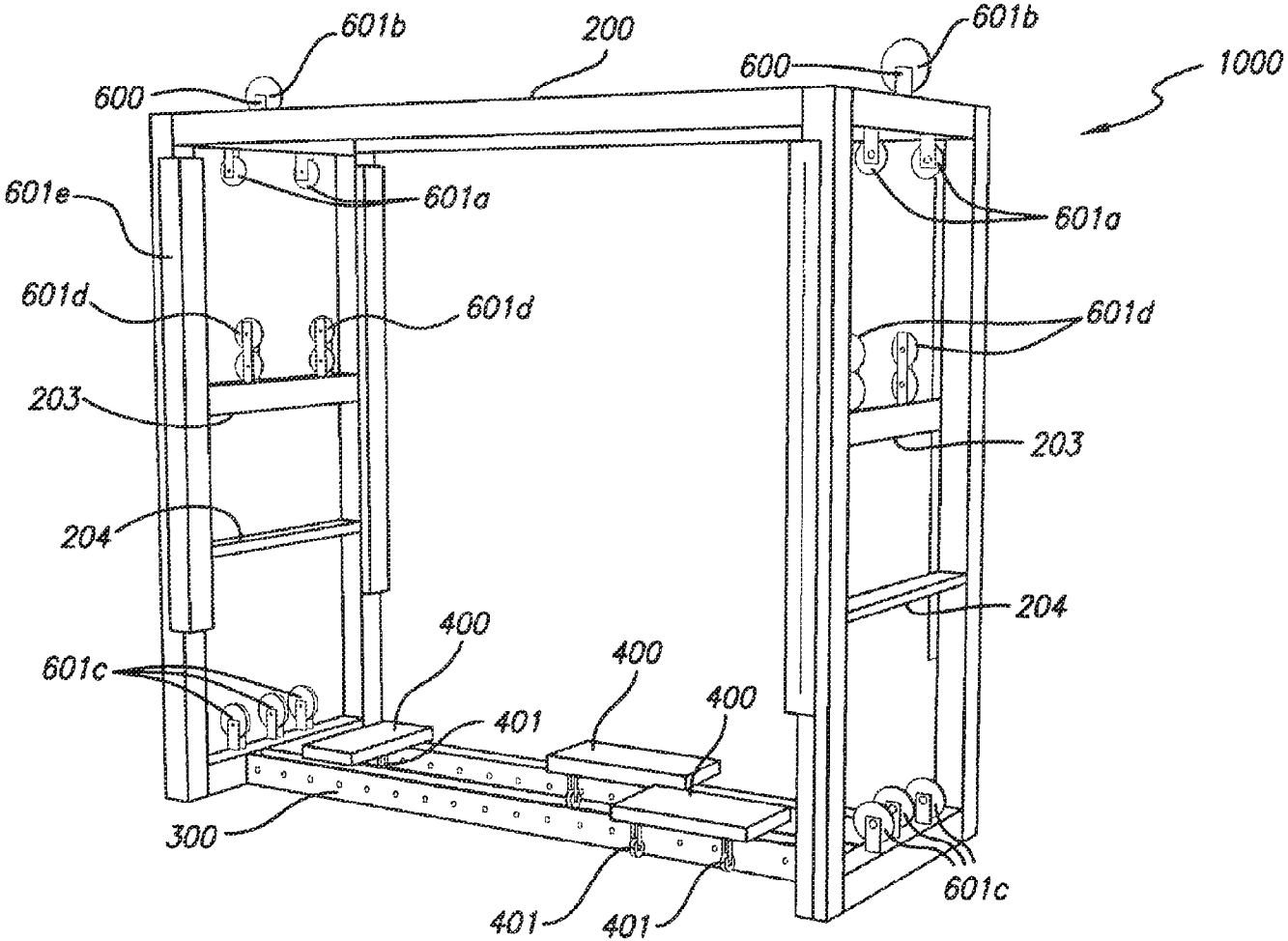
FIG. 10 is a perspective view of an exercise device, by example only, in accordance with the present invention.

FIG. 10 illustrates, in a perspective view, an exercise device 1000, by example only, in accordance with the present invention. The exercise device 1000 comprises a frame 200; a track 300 being mechanically coupled to the frame 200; a plurality of platforms 400 for accommodating an exerciser's feet 101 (not shown), each platform of the plurality of platforms 400 comprising at least one wheel 401 for facilitating both a divergent movement and a convergent movement, the at least one wheel 401 rolling on the track 300; a structure for tensioning 500 (not shown) being mechanically coupled to the plurality of platforms 400 for facilitating both the divergent movement and the convergent movement and for facilitating an upper body strengthening exercise; and a pulley system 600, the pulley system 600 being mechanically coupled to the frame 200, wherein the tensioning structure 500 is also mechanically coupled to the pulley system 600, wherein the divergent and the convergent movements together comprise at least one movement selected from a group consisting essentially of a horizontal split and a lunge split, wherein the track 300 comprises a structure for stopping 700 (not shown) at least one platform of the plurality of platforms 400, wherein the stopping structure 700 comprises at least one hole 701 (not shown) for accommodating a pin 702 for limiting a range of motion in a selected direction, wherein the at least one hole 701 comprises a plurality of intermittent holes for facilitating selection of a direction by the exerciser 100, whereby an exercise is facilitated, wherein the at least one exercise comprises at least one technique selected from a group consisting essentially of a cardiovascular technique and an isometric technique, and wherein the tensioning structure comprises at least one mechanism selected from a group consisting essentially of a spring, a piston, and a hydraulic pump. The at least one wheel 401 may be mounted at a location such as on the lower surfaces of the plurality of platforms 400 and on the sides of the plurality of platforms 400. The pulley system 600 alternatively comprises at least one set of elements such as a plurality of outer upper fixed pulleys 601*a*, a plurality of inner upper fixed pulleys 601*b*, a plurality of lower fixed pulleys 601*c*, a plurality of adjustable double pulleys 601*d*, and an adjustable pulley bar cover 601*e*, the adjustable double pulleys 601*d* being mechanically coupled to the adjustable pulley bar cover 601*e*. The frame 200*a* further comprises a bar member 204 for supporting an exerciser's feet during a push-up exercise.

Figure 11:
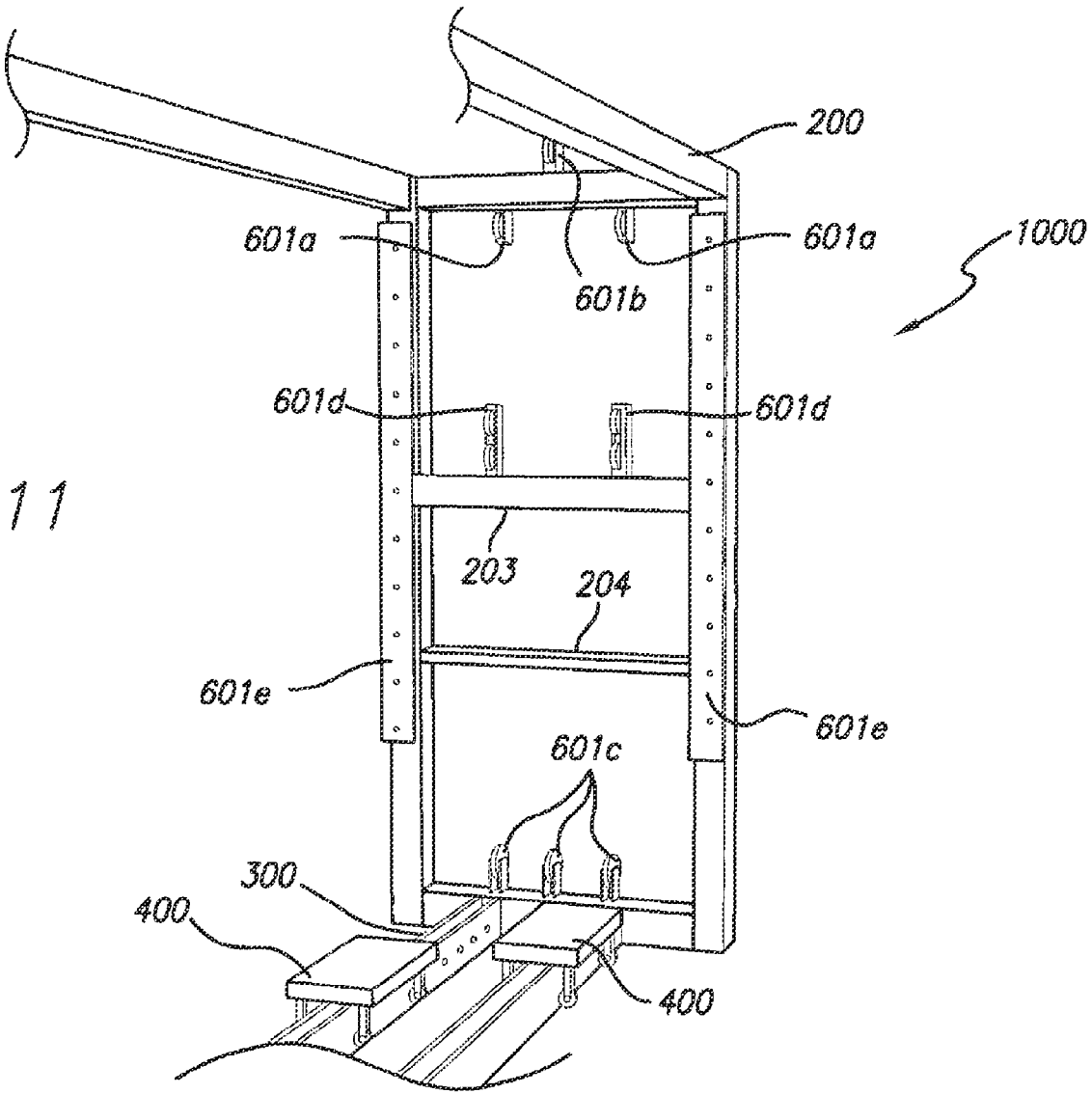
FIG. 11 is a cut-away perspective view of an exercise device, showing the orientation of a plurality of pulleys, by example only, in accordance with the present invention.

FIG. 11 illustrates, in a cut-away perspective view, an exercise device 1000, showing the orientation of a plurality of pulleys 601*a*, 601*b*, 601*c*, 601*d*, and an adjustable pulley bar cover 601*e* of the pulley system 600, and a parallel orientation of the platforms 400 in relation to the track 300, by example only, in accordance with the present invention. The pulley system 600 may comprise three separate pulley subsystems, i.e., defined by the respective pluralities of pulleys 601*a*, 601*c*, 601*d*, on opposing sides of the frame 200. In performing a horizontal split exercise, an inboard pulley of the plurality of lower fixed pulleys 601*c* and an inboard pulley of the plurality of the fixed inner upper fixed pulley 601*b* are used in combination. In performing a lunge split exercise or a cross-country ski exercise, the outboard. pulleys of the plurality of lower fixed pulleys 601*c*, the outboard pulleys of the plurality of outer upper fixed pulleys 601*a*, and the double pulleys 601*d* on the adjustable bar cover 601*e* are used in combination.

Figure 12:
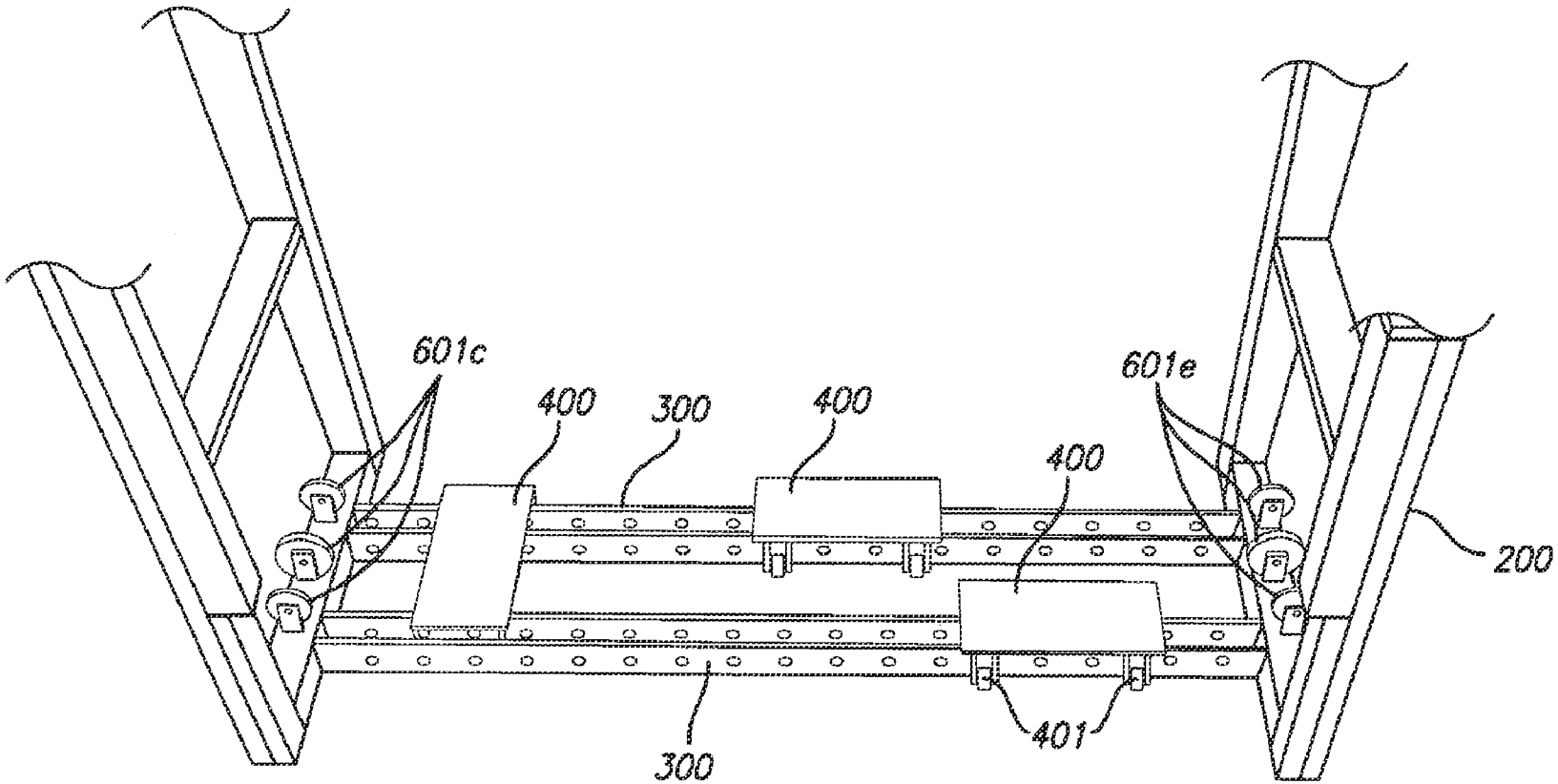
FIG. 12 is a cut-away perspective view of an exercise device, showing the orientation of a plurality of platforms, by example only, in accordance with the present invention.

FIG. 12 illustrates, in a cut-away perspective view, an exercise device 1000, showing the orientation of a plurality of platforms 400, by example only, in accordance with the present invention. Each platform of the plurality of platforms 400 is disposed in a perpendicular orientation in relation to the track 300 for performing a horizontal split exercise. Conversely, each platform of the plurality of platforms 400 is disposed in a parallel orientation in relation to the track 300 for performing a lunge split exercise or a cross-country ski exercise. The platforms 400 may be removed from the track 300 and reoriented onto the track at the selection of the exerciser. The wheels 401 are configured in a manner as described with respect to FIGS. 13 and 14, infra, in order to achieve such convertibility.

FIG. 13 illustrates, in a cut-away perspective view, an exercise device 1000, showing the orientation of a plurality of platforms 400 in relation to a track 300, by example only, in accordance with the present invention. Each platform of the plurality of platforms 400 may comprise a plurality of wheels 401, the plurality of wheels 401 comprising a plurality of inboard wheels and a plurality of outboard wheels, wherein the plurality of inboard wheels are oriented parallel to the length of the platform for facilitating performance of a lunge split exercise or a cross-country ski exercise, and wherein the plurality of outboard wheels are oriented perpendicular to the length of the platform for facilitating performance of a horizontal split exercise, thereby providing a wide range of motion for the exerciser.

FIG. 14 is a perspective view of a lower surface 403 of a platform 400, showing the orientation of a plurality of wheels 401 for facilitating either a perpendicular orientation of the platform 400 to the track 300 or a parallel orientation of the platform 400 to the track 300, by example only, in accordance with the present invention. As described with respect to FIG. 14, the plurality of wheels 401 comprises a plurality of inboard wheels and a plurality of outboard wheels, wherein the plurality of inboard wheels are oriented parallel to the length of the platform for facilitating performance of a lunge split exercise or a cross-country ski exercise, and wherein the plurality of outboard wheels are oriented perpendicular to the length of the platform for facilitating performance of a horizontal split exercise, thereby providing a wide range of motion for the exerciser. When performing a lunge split exercise, the platforms 400 can pass one another. The platform 400 further comprises a plurality of horizontally-oriented wheels (not shown) being incident and rolling on at least one vertical portion 301 of the track 300 for providing additional structural stability to the platform 400.

Figure 15:
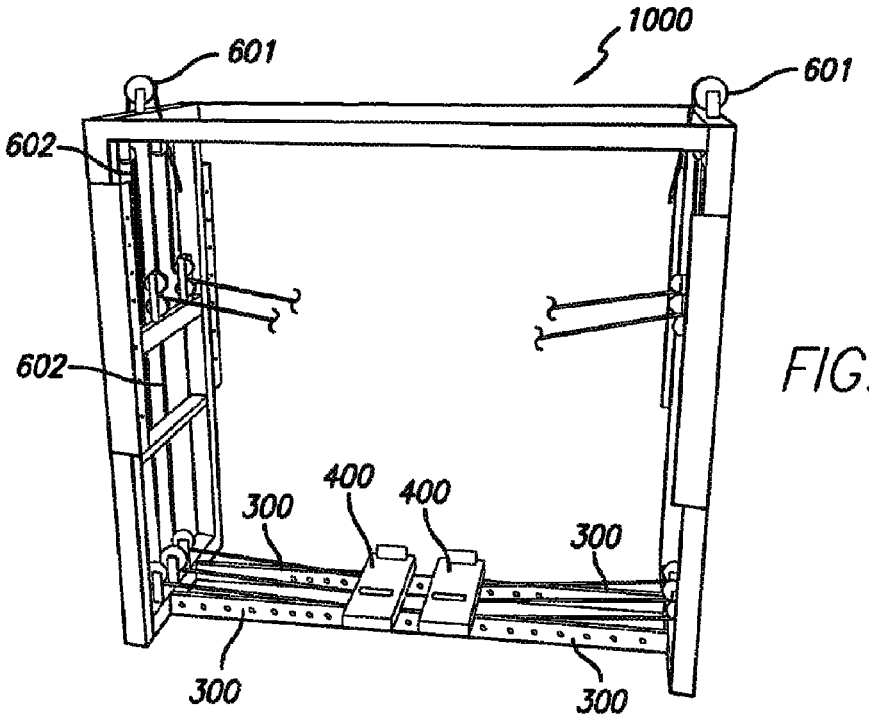
FIG. 15 is a perspective view of an exercise device, having a plurality of pulleys shown in relation to a plurality of cables, in accordance with the present invention.

FIG. 15 illustrates, in a perspective view, an exercise device 1000 having a plurality of pulleys 601 shown in relation to a plurality of cables 602, in accordance with the present invention.

Figure 16:
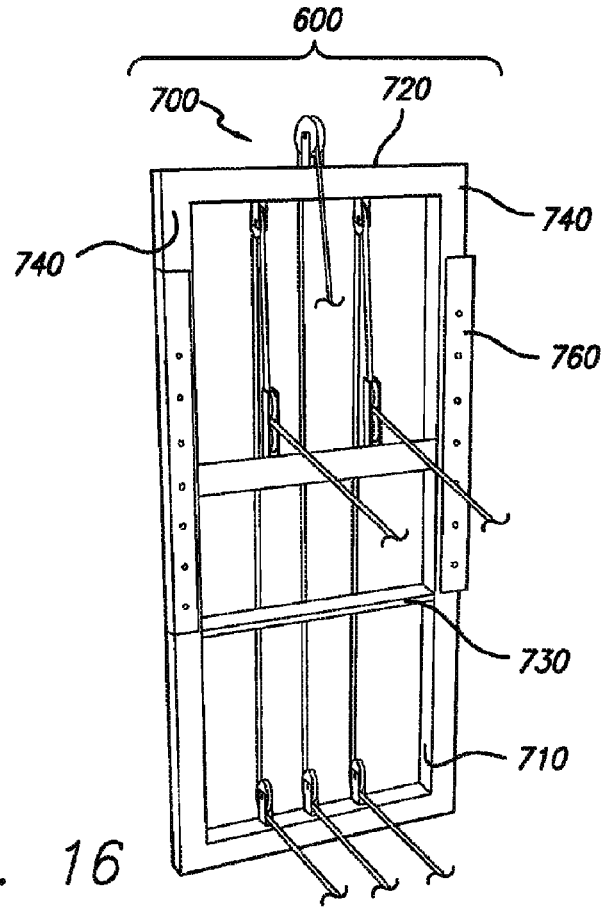
FIG. 16 is a perspective view of a side frame of an exercise device, comprising a pulley system, the pulley system comprising a plurality of pulleys and a plurality of cables, in accordance with the present invention.

FIG. 16 illustrates, in a perspective view, a side frame 700 of an exercise device 1000, comprising a pulley system 600 having a plurality of pulleys 601 and a plurality of cables 602, wherein the side frame 700 comprises a lower side frame portion 710, an upper side frame portion 720, a push-up frame portion 730, at least one perforated vertical frame portion 740, an adjustable pulley frame portion 750, and a rigid cover portion 760, in accordance with the present invention.

Figure 17:
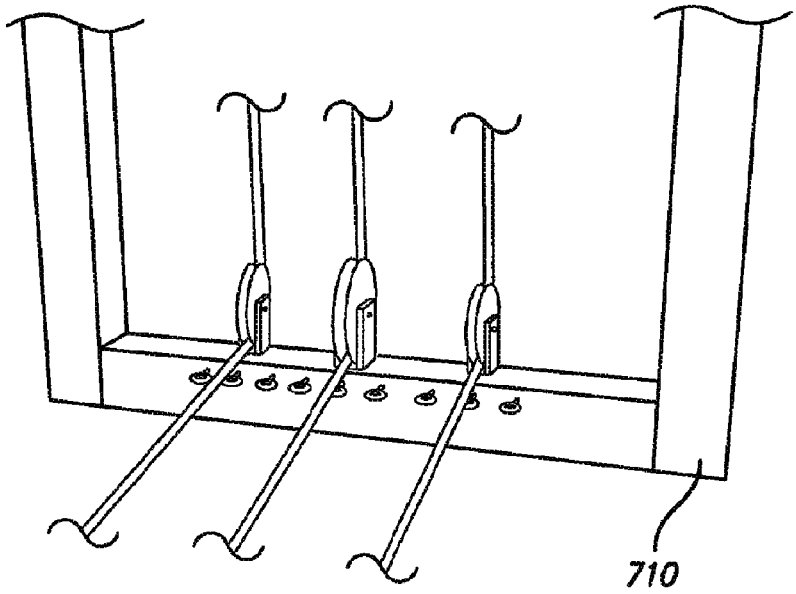
FIG. 17 is a perspective view of a lower side frame portion of the side frame, accordance with a preferred embodiment of the present invention.

FIG. 17 illustrates, in a perspective view, a lower side frame portion 710 of a side frame 700, wherein the lower side frame portion 710 is hollow and comprises dimensions of approximately 36 inches×4 inches×4 inches, a thickness of approximately 0.25 inch, wherein the lower side frame portion 710 comprises nine frame spring connections (not shown) for alignment with corresponding platform spring connections (not shown), three holes (not shown) for accommodating pulley connections (not shown), wherein the middle hole is centered and the outer holes have 15-inch centers, and wherein the lower side frame portion 710 comprises at least one material such as aluminum, aluminum 6063, aluminum 6351, steel, carbon, carbon type 1010, and carbon type 1015, in accordance with a preferred embodiment of the present invention.

Figure 18:
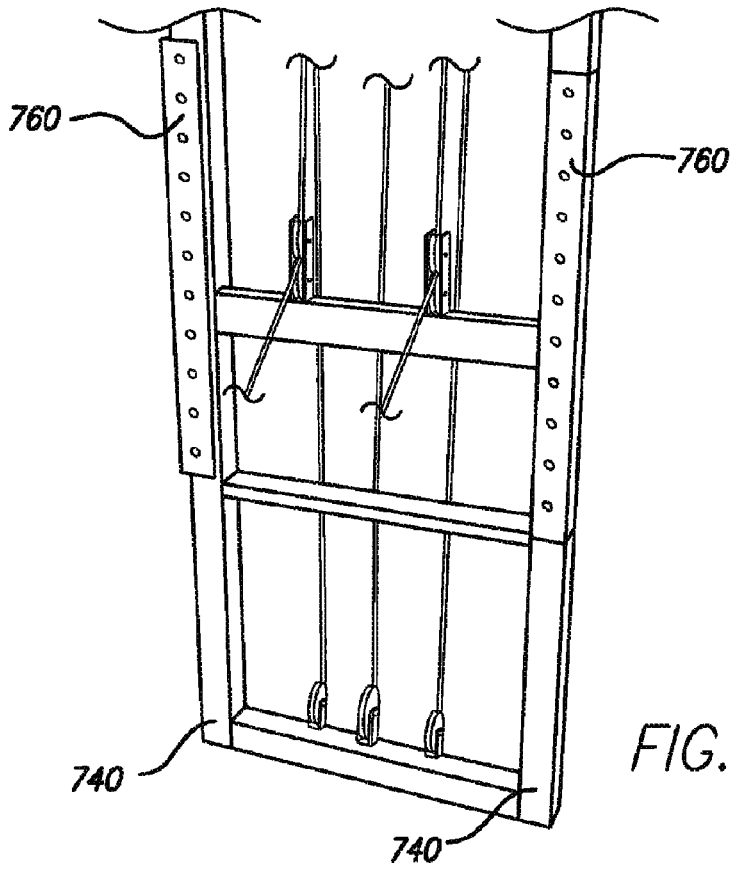
FIG. 18 is a perspective view of vertical frame portions of a side frame, in accordance with a preferred embodiment of the present invention.

FIG. 18 illustrates, in a perspective view, two vertical frame portions 740 of a side frame 700, by example only, wherein the vertical frame portions 740 are hollow and comprise dimensions of approximately 96 inches×4 inches×4 inches, a thickness of approximately 0.25 inch, wherein the vertical frame portions 740 comprise a plurality of perforations 743 through a inner side of the vertical frame portion 740 for mating with connecting elements (not shown) of the rigid cover portion 760, and wherein the vertical frame portion 740 comprises at least one material such as aluminum, aluminum 6063, aluminum 6351, steel, carbon, carbon type 1010, and carbon type 1015, in accordance with a preferred embodiment of the present invention.

Figure 19:
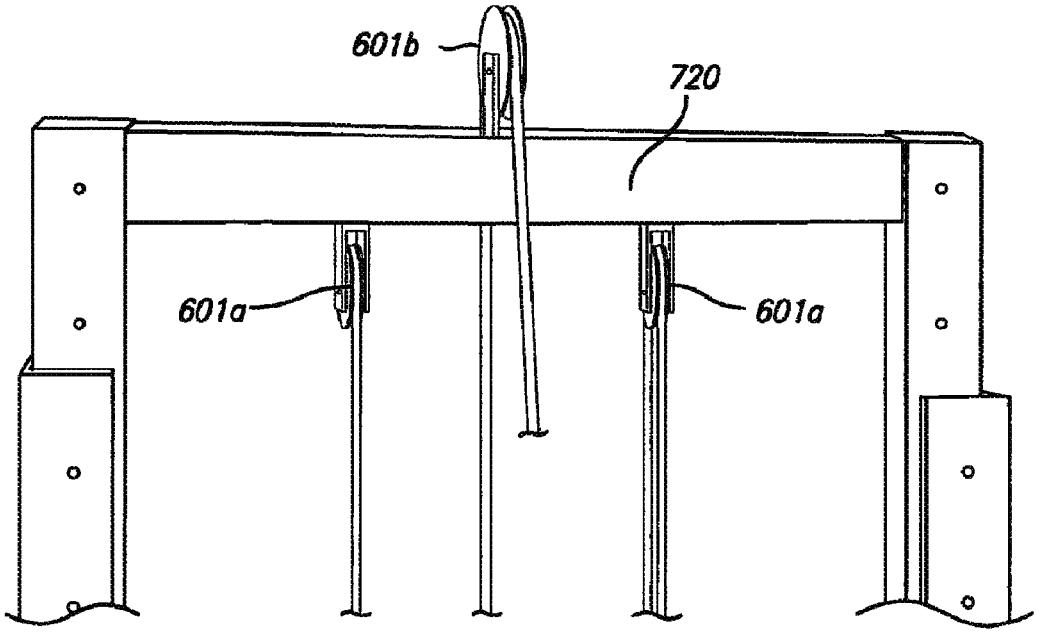
FIG. 19 is a perspective view of an upper side frame portion of the side frame, in accordance with a preferred embodiment of the present invention.

FIG. 19 illustrates, in a perspective view, an upper side frame portion 720, wherein the upper side frame portion 720 is hollow and comprises dimensions of approximately 36 inches×4 inches×4 inches, a thickness of approximately 0.25 inch, wherein the upper side frame portion 720 comprises a plurality of holes 723 for accommodating pulley connections (not shown), wherein the middle hole is centered for accommodating a top pulley 601*b* and the outer holes have 15-inch centers for accommodating two lower pulleys 601*a*, and wherein the upper side frame portion 720 comprises at least one material such as aluminum, aluminum 6063, aluminum 6351, steel, carbon, carbon type 1010, and carbon type 1015, in accordance with a preferred embodiment of the present invention.

Figure 20:
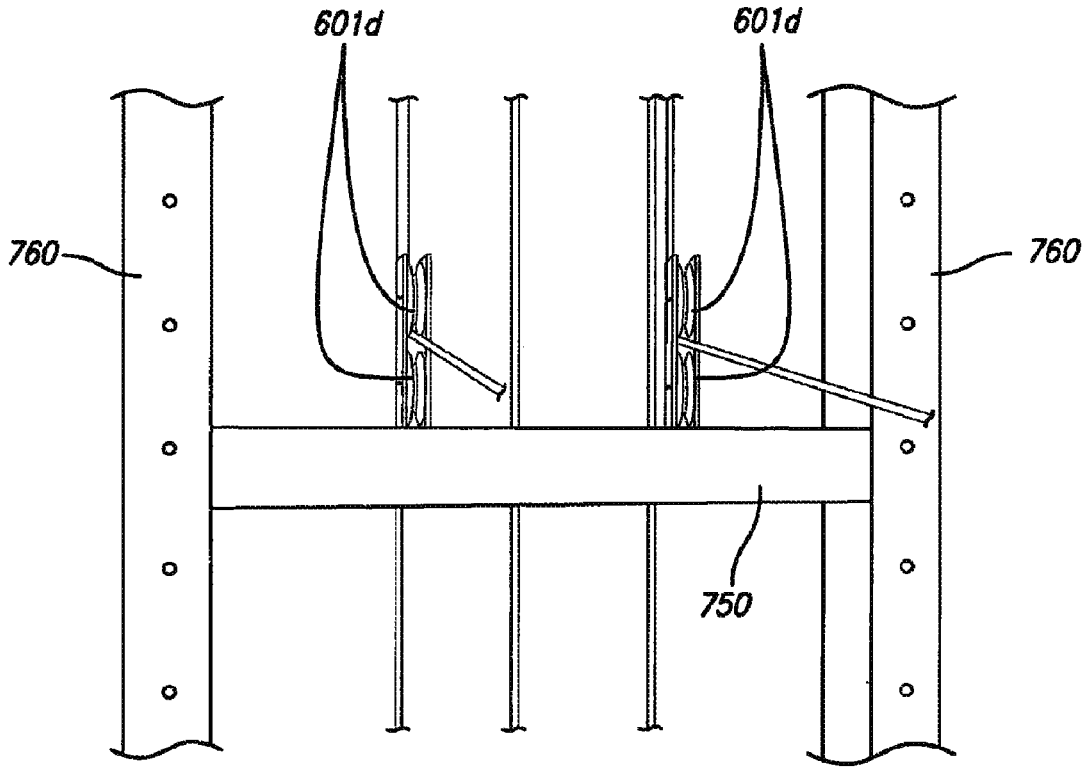
FIG. 20 is a perspective view of an adjustable pulley frame portion of the side frame, in accordance with a preferred embodiment of the present invention.

FIG. 20 illustrates, in a perspective view, an adjustable pulley frame portion 750, wherein the adjustable pulley frame portion 750 comprises dimensions of approximately 44 inches×4 inches, a thickness of approximately 0.25 inch, wherein the adjustable pulley frame portion 750 comprises a two holes (not shown) for accommodating pulley connections (not shown) having 15-inch centers for accommodating two lower pulleys 601*d*, and wherein the adjustable pulley frame portion 750 comprises at least one material such as aluminum, aluminum 6063, aluminum 6351, steel, carbon, carbon type 1010, and carbon type 1015, in accordance with a preferred embodiment of the present invention.

Figure 21:
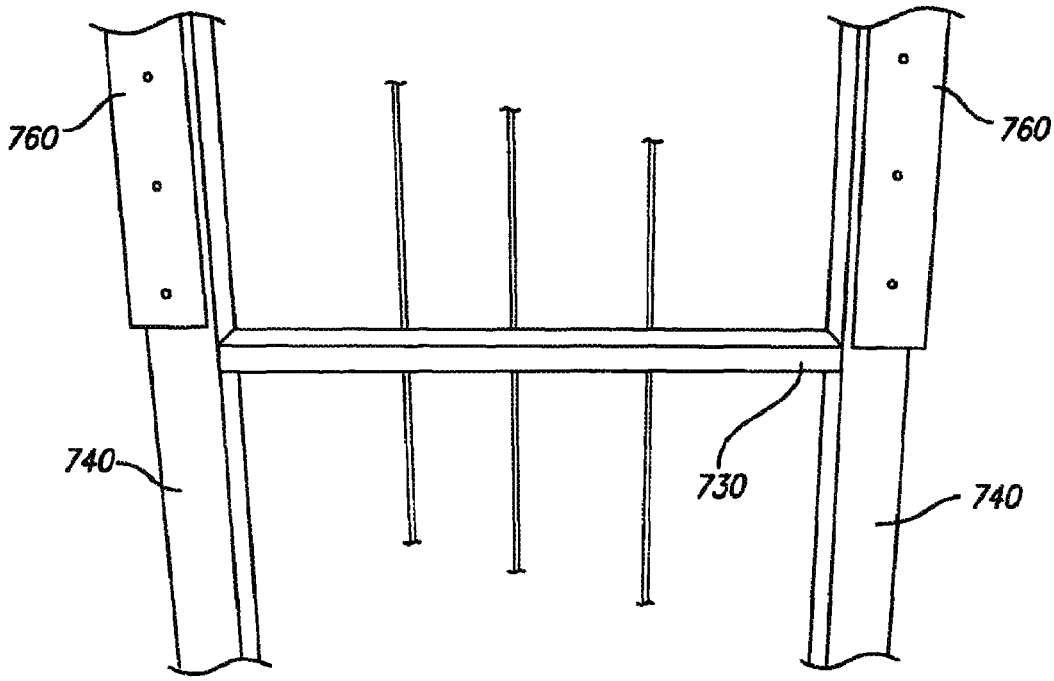
FIG. 21 is a perspective view of a push-up frame portion of the side frame, in accordance with a preferred embodiment of the present invention.

FIG. 21 illustrates, in a perspective view, a push-up frame portion 730, wherein the push-up frame portion 730 comprises an element such as a grip, a gripping material, and a grip tape (not shown) on at least one surface of the push-up frame portion 730, such as a top surface, wherein the push-up frame portion 730 comprises dimensions of approximately 36 inches×4 inches×1 inch, and wherein the push-up frame portion 730 comprises at least one material such as aluminum, aluminum 6063, aluminum 6351, steel, carbon, carbon type 1010, and carbon type 1015, in accordance with a preferred embodiment of the present invention.

Figure 22:
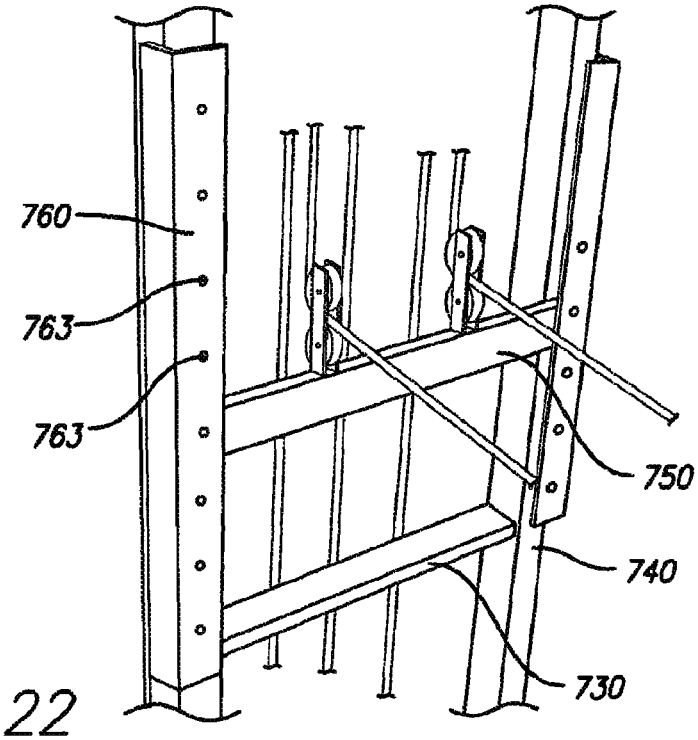
FIG. 22 is a perspective view of a rigid cover portion of the side frame, in accordance with a preferred embodiment of the present invention.

FIG. 22 illustrates, in a perspective view, a rigid cover portion 760, wherein the rigid cover portion 760 spans approximately 4 feet, wherein the rigid cover portion 760 comprises a plurality of tap holes 763 being accurately registrable with the plurality of vertical frame perforations 743 (not shown), wherein the rigid cover portion 760 maintains the vertical motion of the adjustable pulley bar portion 750, and wherein the rigid cover portion 760 comprises at least one material such as a polymer, a polyvinylchloride (PVC), a transparent polymer an opaque polymer, a translucent polymer, in accordance with a preferred embodiment of the present invention.

Figure 23:
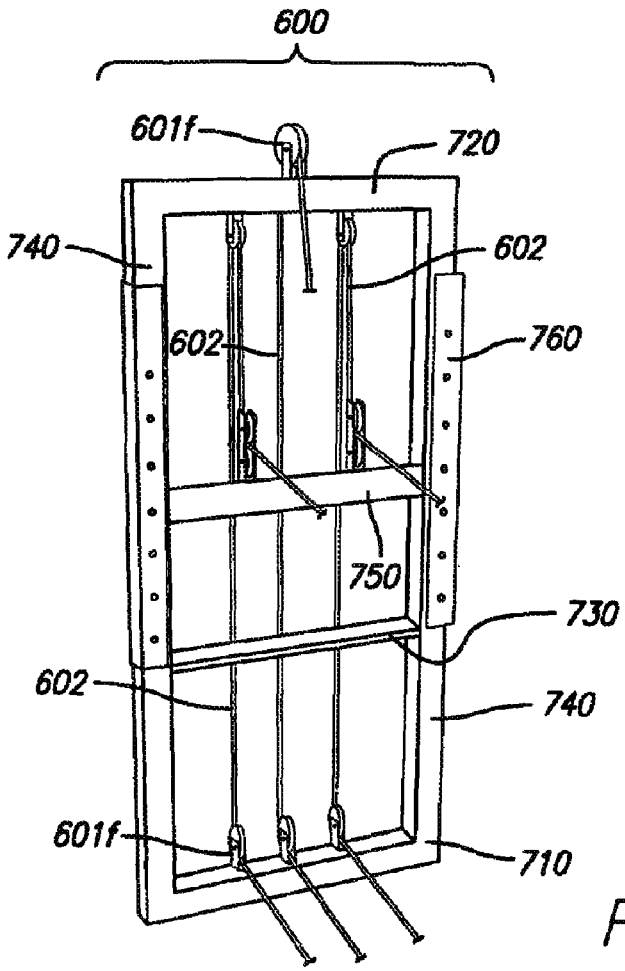
FIG. 23 is a perspective view of a pulley system comprising plurality of pulleys connected to a vertical frame, in accordance with a preferred embodiment of the present invention.

FIG. 23 illustrates, in a perspective view, a pulley system 600 comprising plurality of pulleys 601 connected to a vertical frame portion 740, wherein each pulley of the plurality of pulleys 601 comprises a diameter in a range of approximately 4 inches to approximately 6 inches, wherein the pulley system 600 comprises a plurality of pulley holders 601*f*, wherein each holder of the plurality of pulley holders 601*f* comprises at least one material such as such as aluminum, aluminum 2124, aluminum 6351, steel, stainless steel 410, stainless steel 420, stainless steel 430, and wherein the pulleys 601 comprise at least one material such as a polymer, nylon, cast nylon, and molding grade cast nylon 6/6, in accordance with a preferred embodiment of the present invention.

Figure 24:
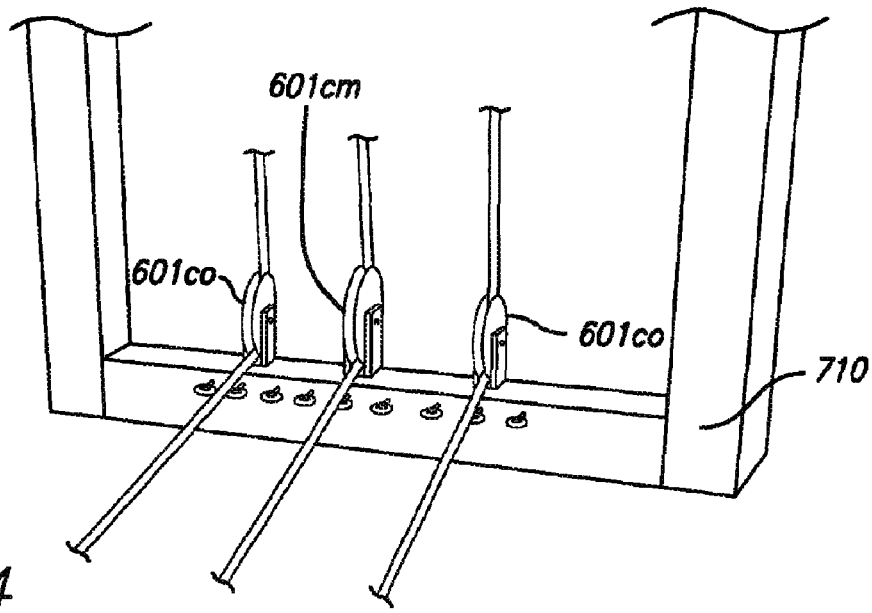
FIG. 24 is a perspective view of a plurality of lower pulleys in a pulley system, in accordance with a preferred embodiment of the present invention.

FIG. 24 illustrates, in a perspective view, a plurality of lower pulleys in a pulley system, wherein a lower middle pulley comprises a diameter of approximately 6 inches and is in alignment with an upper middle pulley (fixed), wherein each of the two lower outer pulleys comprises a diameter of approximately 5 inches, and wherein the back of the lower outer pulleys align with the back of the upper outer pulleys which are connected to the bottom of the upper side frame, in accordance with a preferred embodiment of the present invention.

Figure 25:
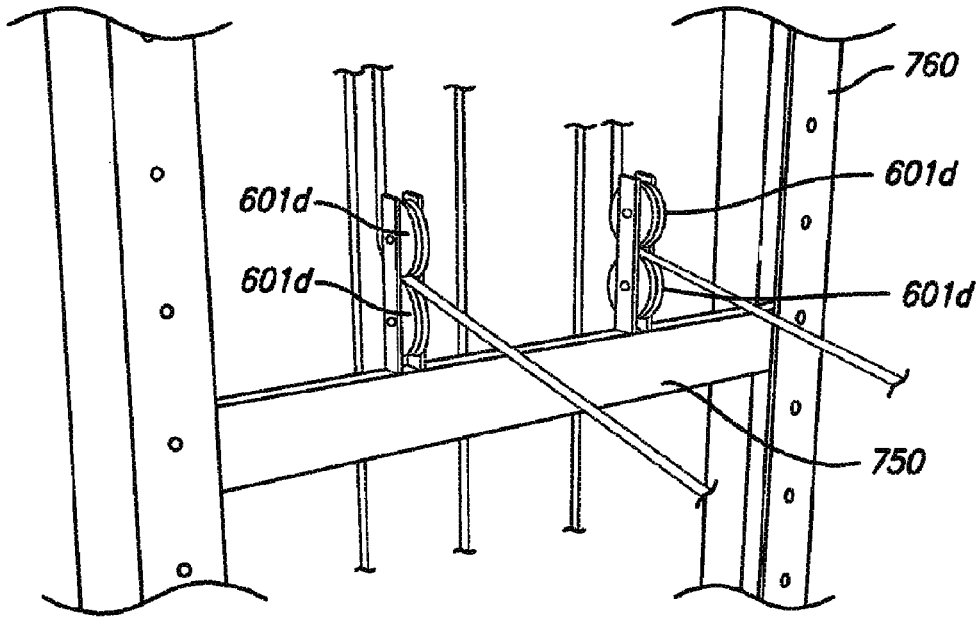
FIG. 25 is a perspective view of a plurality of adjustable pulleys in a pulley system, in accordance with a preferred embodiment of the present invention.

FIG. 25 illustrates, in a perspective view, a plurality of adjustable pulleys 601*d* in a pulley system 600, wherein the adjustable pulleys 601*d* are fastened to the adjustable pulley frame portion 750, wherein the adjustable pulleys 601*d* comprise double pulleys with one pulley being disposed over the other pulley, wherein each adjustable pulley 601*d* comprises a diameter of approximately 4 inches, and wherein the back of the adjustable pulleys 601*d* align with the front of the upper outer pulleys 601*a* which are connected to the bottom of the upper side frame portion 720, in accordance with a preferred embodiment of the present invention.

Figure 26:
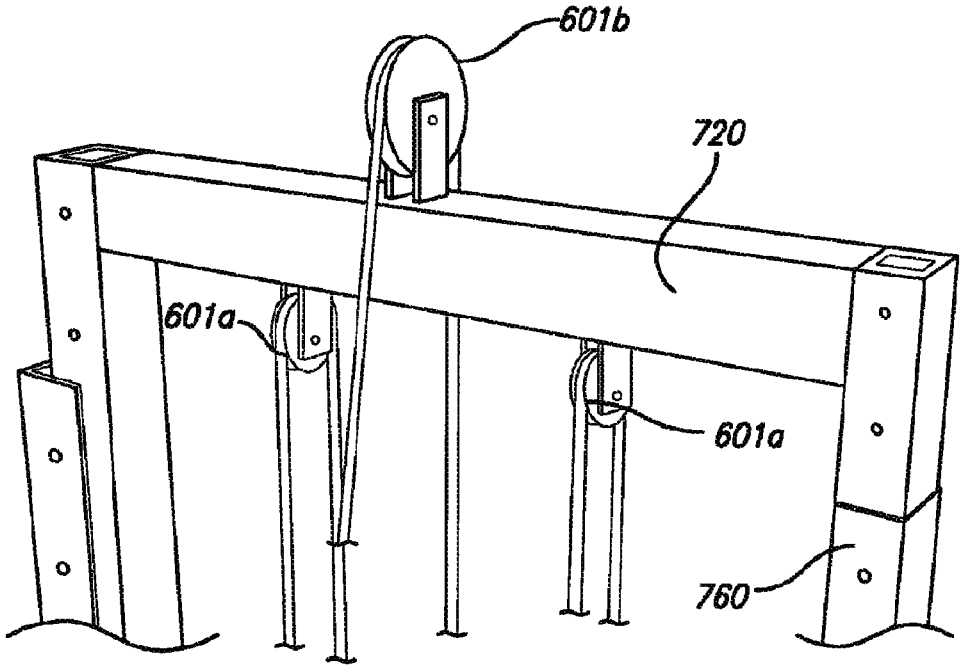
FIG. 26 is a perspective view of a plurality of upper pulleys in a pulley system, in accordance with a preferred embodiment of the present invention.
Figure 27:
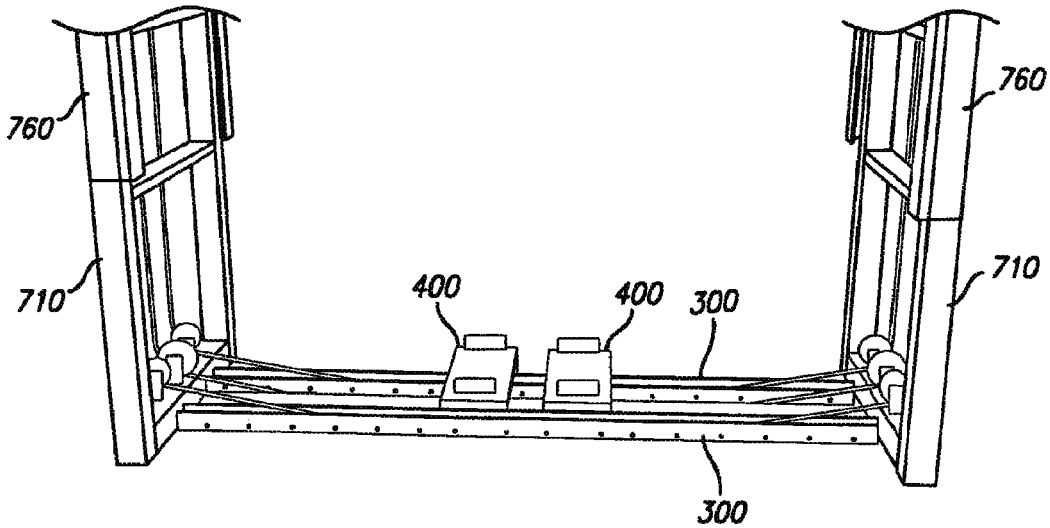
FIG. 27 is a perspective view of a track of an exercise device, wherein the track comprises two rails, in accordance with a preferred embodiment of the present invention.
Figure 28:
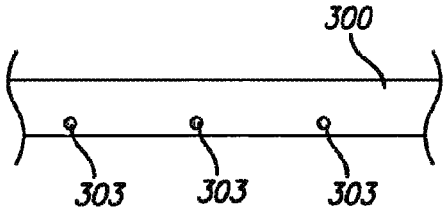
FIG. 28 is a side view of a track of an exercise device, wherein the track comprises a plurality of pin holes for accommodating pins, acting as stops, for restricting motion of the platform wheels, in accordance with a preferred embodiment of the present invention.

FIG. 26 illustrates, in a perspective view, a plurality of upper pulleys in a pulley system 600, wherein an upper middle pulley 601*b* comprises a diameter of approximately 6 inches and is in alignment with a lower middle pulley 601*cm* (fixed and not shown), wherein each of the two upper outer pulleys 601*a* comprises a diameter of approximately 4 inches, wherein the front of the upper outer pulleys 601*a* aligns with the back of the adjustable pulleys 601*d*, and wherein the back of the upper outer pulleys 601*a* aligns with the back of the lower outer pulleys 601*co*, in accordance with a preferred embodiment of the present invention, FIG. 27 illustrates, in a perspective view, a track 300 of an exercise device 1000, wherein the track 300 comprises two rails, wherein each of the two rails comprises a length of approximately 8 feet, a width of approximately 4 inches, and a height of approximately 2.5 inches, and wherein the track 300 comprises at least one material such as aluminum, aluminum 6063, aluminum 6351, steel, stainless steel, stainless steel 410, and stainless steel 430, in accordance with a preferred embodiment of the present invention, FIG. 28 illustrates, in a side view, a track 300 of an exercise device 1000, wherein the track 300 comprises a plurality of pin holes 303 for accommodating a pin, acting as a stop for restricting motion of the wheels, wherein each pin hole of the plurality of pin holes 303 comprises a diameter of approximately 0.5 inch, and wherein the plurality of pinholes 303 are disposed proximate to the lowermost edge of the track 300 and away from the path of the horizontal wheels 401*v* of the platforms 400, in accordance with a preferred embodiment of the present invention.

Figure 29:
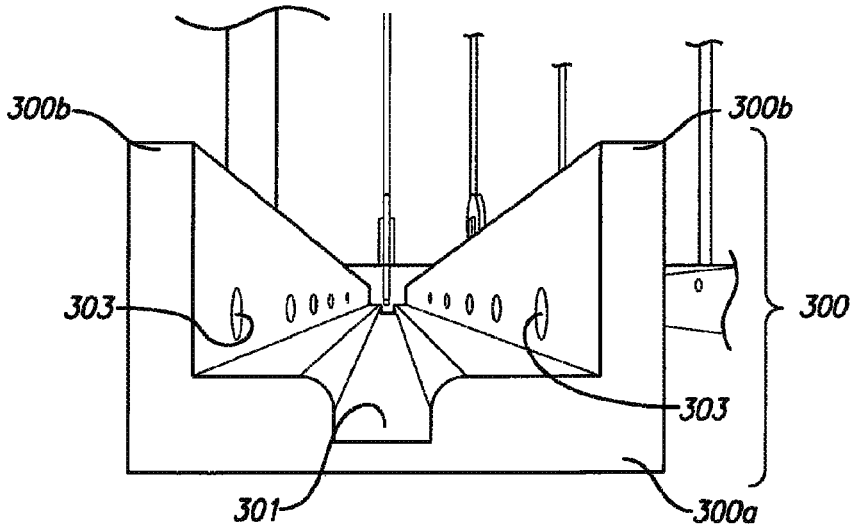
FIG. 29 is an axial perspective view of a track, wherein each rail of the track comprises a bottom portions and two side portions, wherein the bottom portion comprises a recessed lane on its upper surface for accommodating vertical wheels, in accordance with a preferred embodiment of the present invention.

FIG. 29 illustrates, in an axial perspective view, a track 300, wherein the track 300 comprises a bottom portion 300*a* and two side portions 300*b*, wherein each side portion 300*b* comprises a thickness of approximately 0.5 inch, whereby a gap of approximately 3 inches exists between the side portions 300*b* for accommodating horizontal wheels 401*h*, wherein the horizontal wheels 401*h*. comprise a width of approximately 3 inches, wherein the bottom portion 300*a* comprises a thickness of approximately 0.25 inch to 0.75 inch, and wherein the bottom portion 300*a* comprises a recessed lane 301 on its upper surface for accommodating vertical wheels 401*v*, wherein the recessed lane 301 comprises a width of approximately 1 inch, and wherein each vertical wheel 401*v* comprises a width of approximately 1 inch, in accordance with a preferred embodiment of the present invention.

Figure 30:
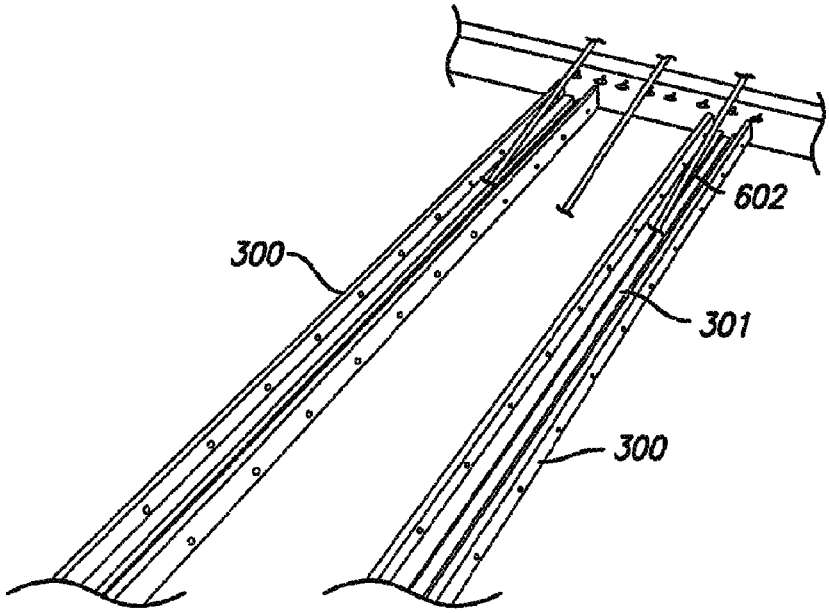
FIG. 30 is a downward perspective view of a track, wherein the rails of the track comprise 15-inch centers for accommodating the platforms in a 0-degree position as well as in a 90-degree position without mechanically conflicting with one another, in accordance with a preferred embodiment of the present invention.

FIG. 30 illustrates, in a downward perspective view, a track 300, wherein the track rails comprise 15-inch centers for accommodating the platforms 400 in a 0-degree position as well as in a 90-degree position without mechanically conflicting with one another, in accordance with a preferred embodiment of the present invention.

Figure 31:
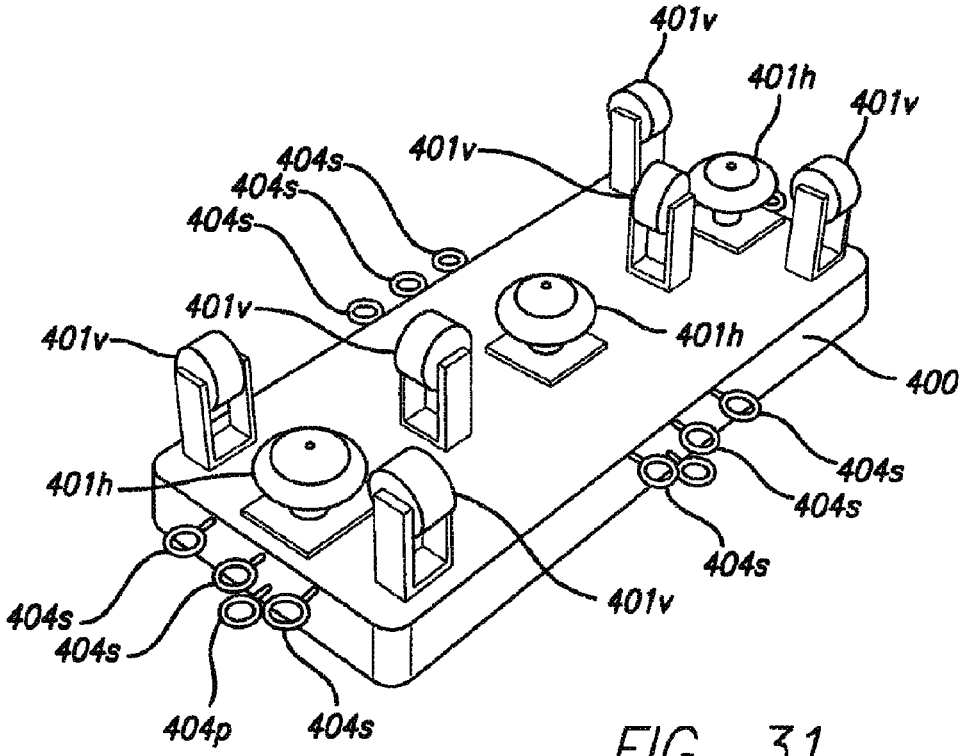
FIG. 31 is a bottom perspective view of a platform, wherein the platform comprises six vertical wheels and three horizontal wheels, and wherein the platform comprises twelve spring connections, three spring connections being disposed on each side of the platform, and four pulley connections, one pulley connection being disposed on each side of the platform, in accordance with a preferred embodiment of the present invention.

FIG. 31 illustrates, in a bottom perspective view, a platform 400, wherein the each platform 400 comprises a length of approximately 22 inches, a width of approximately 9.5 inches, and a height of approximately 2 inches, wherein the platform 400 comprises six vertical wheels 401*v* and three horizontal wheels 401*h*, wherein the vertical wheels 401*v* comprise a diameter of approximately 2 inches and a thickness of approximately 1 inch, wherein the horizontal wheels 401*h* comprise a diameter of approximately 3 inches and a thickness of approximately 1 inch, and wherein the platform 400 comprises twelve spring connections 404, three spring connections 404*s* being disposed on each side of the platform 400, and four pulley connections 404*p*, one pulley connection 404*p* being disposed on each side of the platform 400, in accordance with a preferred embodiment of the present invention. The spring connections 404 comprise at least one element such as an eyebolt, an eye screw, an eye hook, a hook screw, a pin screw having a transverse hole, an eye nut, a ring bolt, a lifting bolt, a lifting ring, a hoist ring, a U-bolt, a carabiner, a turnbuckle, a tie-down ring with a base plate, a swivel tie-down cleat, an eye swivel, and a security snap.

Figure 32:
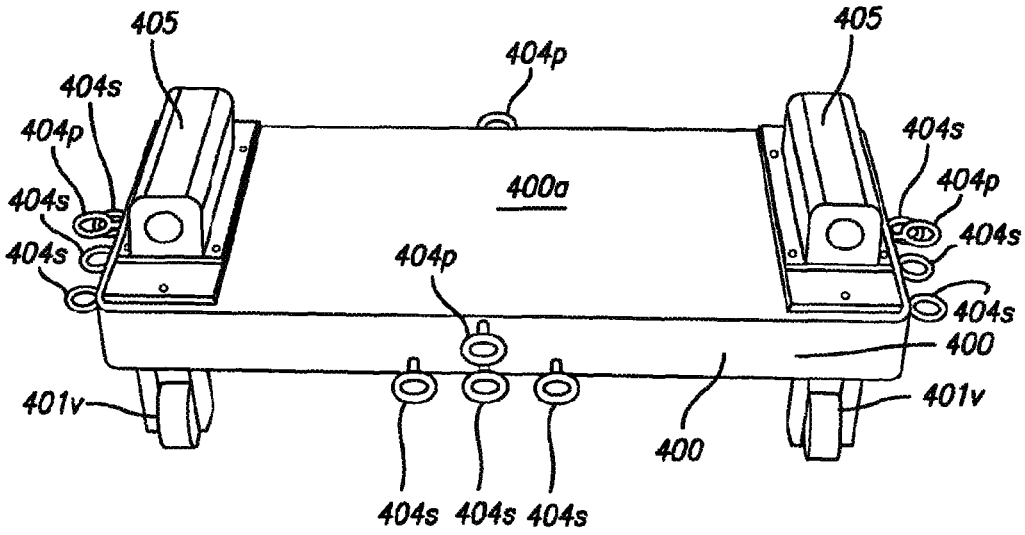
FIG. 32 is a top perspective view of a platform, wherein each platform has a top surface comprises a pair of hollow members being fastened to the top surface for facilitating simultaneous movement of the platforms, wherein the hollow members are stops for an exerciser's feet, wherein each platform comprises a gripping material for providing better friction to an exerciser's foot, and wherein the gripping material conforms to an exerciser's foot, in accordance with a preferred embodiment of the present invention.

FIG. 32 illustrates, ism a top perspective view, a platform 400, wherein each platform 400 has a top surface 400*a* and comprises a pair of hollow members 405 being fastened to the top surface 400*a* for facilitating simultaneous movement of the platforms 400, wherein the hollow members 405 act as stops for an exerciser's feet (not shown), wherein each platform 400 comprises a gripping material (not shown) such as a grip tape on the top surface 400*a* for providing better friction to an exerciser's foot, and wherein the gripping material conforms to an exerciser's foot, in accordance with a preferred embodiment of the present invention.

Figure 33:
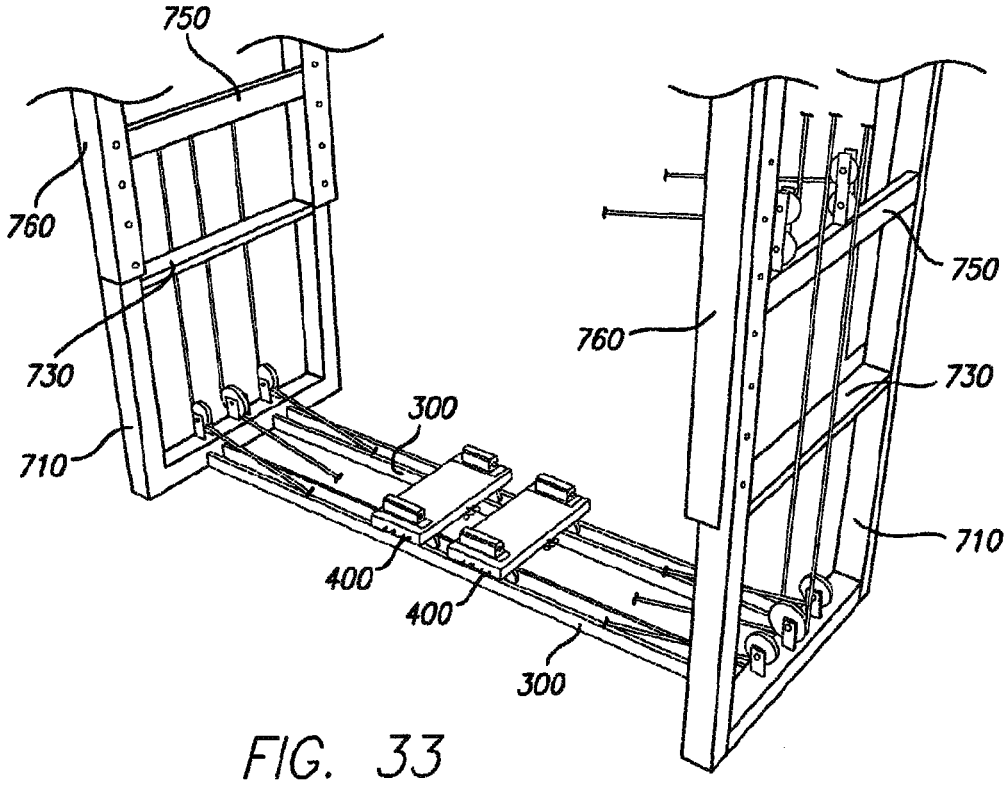
FIG. 33 is a perspective view of two platforms disposed on a track in a 0-degree position, and wherein the vertical wheels are disposed in the rail of the track, in accordance with a preferred embodiment of the present invention.

FIG. 33 illustrates, in a perspective view, two platforms 400 disposed on a track 300 in a 0-degree position, and wherein the vertical wheels 401*v* are disposed in the track 300, in accordance with a preferred embodiment of the present invention.

Figure 34:
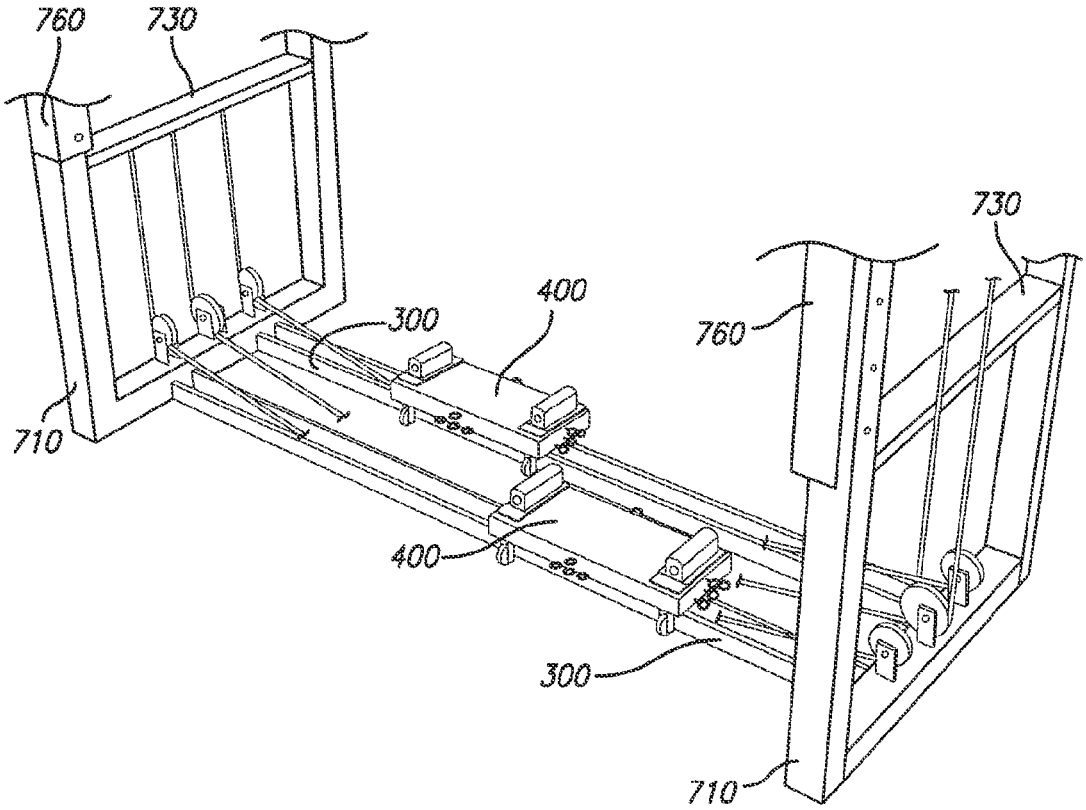
FIG. 34 is a perspective view of two platforms disposed on a track in a 90-degree position, and wherein the horizontal wheels are disposed in the rail of the track, in accordance with a preferred embodiment of the present invention.

FIG. 34 illustrates, in a perspective view, two platforms 400 disposed on a track 300 in a 90-degree position, and wherein the horizontal wheels 401*h* are disposed in the track 300, in accordance with a preferred embodiment of the present invention.

Information, as herein shown and described in detail, is fully capable of attaining the above-described object of the invention, the presently preferred embodiment of the invention, and is, thus, representative of the subject matter which is broadly contemplated by the present invention. The scope of the present invention fully encompasses other embodiments which may become obvious to those skilled in the art, and is to be limited, accordingly, by nothing other than the appended claims, wherein reference to an element in the singular is not intended to mean "one and only one" unless explicitly so stated, but rather "one or more," All structural and functional equivalents to the elements of the above-described preferred embodiment and additional embodiments that are known to those of ordinary skill in the art are hereby expressly incorporated by reference and are intended to be encompassed by the present claims.

Moreover, no requirement exists for a system, an apparatus, a device, or a method to address each and every problem sought to be resolved by the present invention, for such to be encompassed by the present claims. Furthermore, no element, component, or method step in the present disclosure is intended to be dedicated to the public regardless of Whether the element, component, or method step is explicitly recited in the claims. However, that various changes and modifications in form, configuration, method steps, and material detail may be made without departing from the spirit and scope of the inventions as set forth in the appended claims, should be readily apparent to those of ordinary skill in the art. No claim herein is to be construed under the provisions of 35 U.S.C. §112, sixth paragraph, unless the element is expressly recited using the phrase "means for."

INDUSTRIAL APPLICABILITY

The present invention industrially applies to systems, apparatuses, devices, and methods for exercising. More particularly, the present invention industrially applies to systems, apparatuses, devices, and methods for exercising multiple muscle groups. Even more particularly, the present invention industrially applies to systems, apparatuses, devices, and methods for exercising multiple muscle groups simultaneously.

What is claimed:

1. An exercise device, comprising:

a. a box-like frame, comprising:

i. a first and second rectangular frame arranged vertically, the first and second vertical rectangular frames, each comprising:

(a) a lower horizontal bar and an upper horizontal bar, each upper and lower horizontal bars having a first end and a second; and (b) two vertical bars, a first vertical bar connecting the first ends of the upper and lower horizontal bars, and a second vertical bar connecting the second ends of the upper and lower horizontal bars;

ii. and at least four cross bars, wherein a first cross bar connects the first end of the upper horizontal bar of the first rectangular frame to the corresponding first end of the upper horizontal bar of the second rectangular frame, a second cross bar, opposite the first cross bar, connects the second end of the upper horizontal bar of the first rectangular frame to the corresponding second end of the upper horizontal bar of the second rectangular frame, a third cross bar connects the first end of the lower horizontal bar of the first rectangular frame to the corresponding first end of the lower horizontal bar of the second rectangular frame, and a fourth cross bar, opposite the third cross bar, connects the second end of the lower horizontal bar of the first rectangular frame to the corresponding second end of the lower horizontal bar of the second rectangular frame;

b. a track being mechanically coupled to the box-like frame;

c. a plurality of platforms for accommodating an exerciser's feet, each platform of the plurality of platforms comprising at least one moving member for facilitating both a divergent movement and a convergent movement, the at least one moving member moving on the track;

d. a first intermediate cross bar in between the first and third cross bars connecting the first rectangular frame to the second rectangular frame;

e. a second intermediate cross bar in between the second and fourth cross bars; and f. a pulley system mechanically coupled to at least two cross bars selected from the group consisting of the first cross bar, the second cross bar, the third cross bar, the fourth cross bar, the first intermediate cross bar, and the second intermediate cross bar, g. wherein the pulley system comprises a plurality of cables, wherein each cable directly connects one of the plurality of platforms to a handle.

2. A device, as recited in claim 1, wherein the track comprises means for stopping at least one platform of the plurality of platforms.

3. A device, as recited in claim 1, further comprising means for tensioning being mechanically coupled to the plurality of platforms.

4. A device, as recited in claim 1, wherein the at least one moving member comprises at least one wheel disposed at a location selected from a group consisting of on a lower surface of each platform of the plurality of platforms and on a side of each platform of the plurality of platforms.

5. A device, as recited in claim 4, a. wherein the at least one wheel disposed on a lower surface of each platform includes at least one inboard wheel and at least one outboard wheel, b. wherein the at least one inboard wheel is oriented parallel to a length of the platform, and c. wherein the at least one outboard wheel is oriented perpendicular to a length of the platform.

6. A device, as recited in claim 1, wherein the at least one moving member comprises at least one monocoque structure disposed at a location selected from a group consisting of on a lower surface of each platform of the plurality of platforms and on a side of each platform of the plurality of platforms.

7. A device, as recited in claim 1, a. wherein the plurality of platforms are rotatable for facilitating switching from a horizontal split exercise to a lunge split exercise, and b. wherein the plurality of platforms is articulable for accommodating the relative orientations of an exerciser's feet.

8. An exercise device, comprising:

a. a box-like frame, comprising:

i. a first and second rectangular frame arranged vertically, the first and second vertical rectangular frames, each comprising:

(a) a lower horizontal bar and an upper horizontal bar, each upper and lower horizontal bars having a first end and a second; and (b) two vertical bars, a first vertical bar connecting the first ends of the upper and lower horizontal bars, and a second vertical bar connecting the second ends of the upper and lower horizontal bars;

ii. and at least four cross bars, wherein a first cross bar connects the first end of the upper horizontal bar of the first rectangular frame to the corresponding first end of the upper horizontal bar of the second rectangular frame, a second cross bar, opposite the first cross bar, connects the second end of the upper horizontal bar of the first rectangular frame to the corresponding second end of the upper horizontal bar of the second rectangular frame, a third cross bar connects the first end of the lower horizontal bar of the first rectangular frame to the corresponding first end of the lower horizontal bar of the second rectangular frame, and a fourth cross bar, opposite the third cross bar, connects the second end of the lower horizontal bar of the first rectangular frame to the corresponding second end of the lower horizontal bar of the second rectangular frame;

b. a track being mechanically coupled to the box-like frame;

c. a plurality of platforms for accommodating an exerciser's feet, each platform of the plurality of platforms comprising at least one moving member for facilitating both a divergent movement and a convergent movement, the at least one moving member moving on the track; and d. a pulley system is adjustably coupled to at least two cross bars selected from the group consisting of the first cross bar, the second cross bar, the third cross bar, and the fourth cross bar, wherein the pulley system comprises a plurality of cables, wherein each cable directly connects one of the plurality of platforms to a handle.

9. The exercise device of claim 8, further comprising:

a. a first intermediate cross bar in between the first and third cross bars connecting the first rectangular frame to the second rectangular frame;

b. a second intermediate cross bar in between the second and fourth cross bars, c. wherein the pulley system is mechanically coupled to at least two cross bars selected from the group consisting of the first cross bar, the second cross bar, the third cross bar, the fourth cross bar, the first intermediate cross bar, and the second intermediate cross bar.

10. A device, as recited in claim 8, wherein the track comprises means for stopping at least one platform of the plurality of platforms.

11. A device, as recited in claim 8, further comprising means for tensioning being mechanically coupled to the plurality of platforms.

12. A device, as recited in claim 8, wherein the at least one moving member is selected from a group consisting of a wheel and a monocoque structure, the at least one moving member disposed at a location selected from a group consisting of on a lower surface of each platform of the plurality of platforms and on a side of each platform of the plurality of platforms.

13. A device, as recited in claim 12, a. wherein the at least one wheel disposed on a lower surface of each platform includes at least one inboard wheel and at least one outboard wheel, b. wherein the at least one inboard wheel is oriented parallel to a length of the platform, and c. wherein the at least one outboard wheel is oriented perpendicular to a length of the platform.

14. A device, as recited in claim 8, wherein the plurality of platforms are articulable.

15. An exercise device, comprising:

a. a box-like frame, comprising:

i. a first and second rectangular frame arranged vertically, the first and second vertical rectangular frames, each comprising:

(a) a lower horizontal bar and an upper horizontal bar, each upper and lower horizontal bars having a first end and a second; and (b) two vertical bars, a first vertical bar connecting the first ends of the upper and lower horizontal bars, and a second vertical bar connecting the second ends of the upper and lower horizontal bars;

ii. and at least four cross bars, wherein a first cross bar connects the first end of the upper horizontal bar of the first rectangular frame to the corresponding first end of the upper horizontal bar of the second rectangular frame, a second cross bar, opposite the first cross bar, connects the second end of the upper horizontal bar of the first rectangular frame to the corresponding second end of the upper horizontal bar of the second rectangular frame, a third cross bar connects the first end of the lower horizontal bar of the first rectangular frame to the corresponding first end of the lower horizontal bar of the second rectangular frame, and a fourth cross bar, opposite the third cross bar, connects the second end of the lower horizontal bar of the first rectangular frame to the corresponding second end of the lower horizontal bar of the second rectangular frame;

b. a plurality of platforms for accommodating an exerciser's feet, each platform of the plurality of platforms comprising at least one moving member for facilitating both a divergent movement and a convergent movement; and c. a pulley system is adjustably coupled to at least two cross bars selected from the group consisting of the first cross bar, the second cross bar, the third cross bar, the fourth cross bar, a first intermediate cross bar, and a second intermediate cross bar, wherein the pulley system comprises a plurality of cables, wherein each cable directly connects one of the plurality of platforms to a handle.

16. A device, as recited in claim 15, wherein the exercise device comprises means for stopping at least one platform of the plurality of platforms.

17. A device, as recited in claim 15, further comprising means for tensioning being mechanically coupled to the plurality of platforms.

18. A device, as recited in claim 15, wherein the at least one moving member is selected from a group consisting of a wheel and a monocoque structure, the at least one moving member disposed at a location selected from a group consisting of on a lower surface of each platform of the plurality of platforms and on a side of each platform of the plurality of platforms.

19. A device, as recited in claim 18, a. wherein the at least one wheel disposed on a lower surface of each platform includes at least one inboard wheel and at least one outboard wheel, b. wherein the at least one inboard wheel is oriented parallel to a length of the platform, and c. wherein the at least one outboard wheel is oriented perpendicular to a length of the platform.

20. A device, as recited in claim 15, wherein the plurality of platforms are articulable.

* * * * *